US009970727B2

(12) United States Patent
Niswander et al.

(10) Patent No.: US 9,970,727 B2
(45) Date of Patent: May 15, 2018

(54) SYSTEMS AND METHODS FOR BARREL ATTACHMENT ASSEMBLIES FOR FIREARMS

(71) Applicant: AGENCY ARMS, LLC, Camarillo, CA (US)

(72) Inventors: Randy Paul Niswander, Oxnard, CA (US); Michael Lee Parks, Canyon County, CA (US)

(73) Assignee: Agency Arms, LLC, Ventura, CA (US)

( * ) Notice: Subject to any disclaimer, the term of this patent is extended or adjusted under 35 U.S.C. 154(b) by 0 days. days.

(21) Appl. No.: 15/403,636

(22) Filed: Jan. 11, 2017

(65) Prior Publication Data

US 2017/0205178 A1 Jul. 20, 2017

Related U.S. Application Data

(60) Provisional application No. 62/279,308, filed on Jan. 15, 2016, provisional application No. 62/332,207, filed on May 5, 2016.

(51) Int. Cl.

| | |
|---|---|
| ***F41A 21/36*** | (2006.01) |
| ***F41A 21/32*** | (2006.01) |
| ***F41A 3/66*** | (2006.01) |
| ***F41C 3/00*** | (2006.01) |

(52) U.S. Cl.

CPC ..... *F41A 21/36* (2013.01); *F41A 3/66* (2013.01); *F41A 21/325* (2013.01); *F41C 3/00* (2013.01)

(58) Field of Classification Search

CPC ..... F41A 21/32; F41A 21/325; F41A 21/34; F41A 21/36; F41A 21/38; F41A 3/66

USPC ..... 89/196; 42/1.06, 14, 16

See application file for complete search history.

(56) References Cited

U.S. PATENT DOCUMENTS

| | | | | | |
|---|---|---|---|---|---|
| 4,534,264 | A * | 8/1985 | Tarnoff | F41A 21/28 | 89/14.3 |
| 4,691,614 | A * | 9/1987 | Leffel | F41A 21/36 | 89/14.3 |
| 5,423,242 | A * | 6/1995 | Schuemann | F41A 21/28 | 89/14.3 |
| 5,563,362 | A * | 10/1996 | York | F41A 21/36 | 89/14.3 |
| 5,955,696 | A * | 9/1999 | Meller | F41A 3/82 | 89/163 |
| 7,194,836 | B1 * | 3/2007 | Urban | F41C 27/22 | 42/106 |
| 7,328,645 | B1 * | 2/2008 | Curry | F41A 21/28 | 42/1.06 |
| D784,479 | S * | 4/2017 | Niswander | D22/108 | |
| 2003/0019352 | A1 * | 1/2003 | Mika | F41A 21/36 | 89/14.05 |
| 2014/0196337 | A1 * | 7/2014 | Bandini | F41A 3/44 | 42/16 |

* cited by examiner

*Primary Examiner* — Bret Hayes

(74) *Attorney, Agent, or Firm* — Eversheds Sutherland (US) LLP

(57) ABSTRACT

A firearm assembly is disclosed. The firearm assembly may include a slide comprising a guide slot and a barrel attachment comprising a main body and an elongated guide beam. The elongated guide beam may be configured to slide within the guide slot.

11 Claims, 28 Drawing Sheets

SYSTEMS AND METHODS FOR BARREL ATTACHMENT ASSEMBLIES FOR FIREARMS

CROSS-REFERENCE TO RELATED APPLICATIONS

The disclosure claims priority to and the benefit of U.S. provisional patent application No. 62/279,308, filed Jan. 15, 2016, which is herein incorporated by reference in its entirety.

The disclosure claims priority to and the benefit of U.S. provisional patent application No. 62/332,207, filed May 5, 2016, which is herein incorporated by reference in its entirety.

FIELD

The disclosure generally relates to firearms and more particularly relates to systems and methods for barrel attachment assemblies.

BACKGROUND

Firearm components and accessories may be attached to the muzzle end of the barrel of a firearm, such as a handgun. In order for the firearm components and accessories to operate most effectively, they should be properly aligned, which may be difficult to achieve before, during, and after discharging the firearm.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Described below are embodiments of barrel attachment assemblies (as well as individual components of the barrel attachment assemblies) that can be incorporated into a firearm. Methods of manufacturing, installing, and using the barrel attachment assemblies on the firearm are also disclosed.

Figure 1:
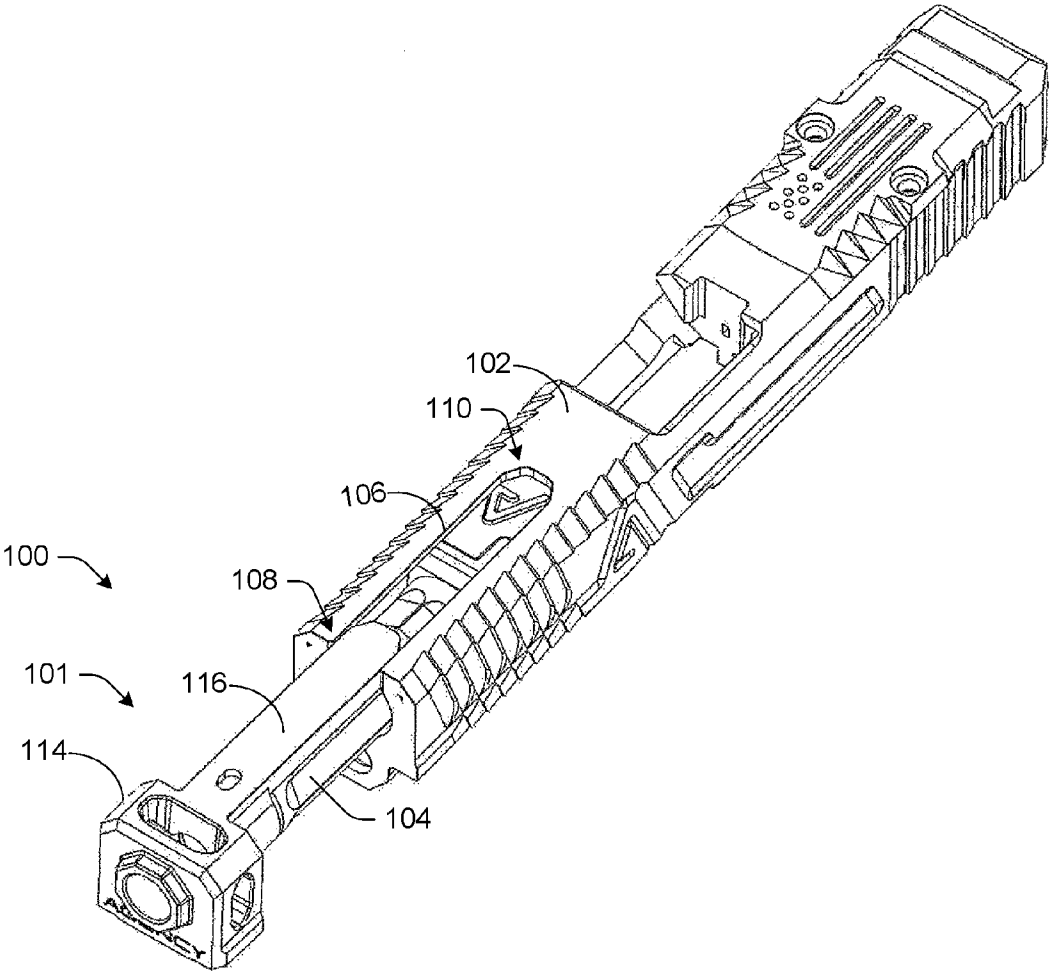
FIG. 1 depicts an upper view of a barrel attachment assembly in accordance with one or more embodiments of the disclosure.
Figure 2:
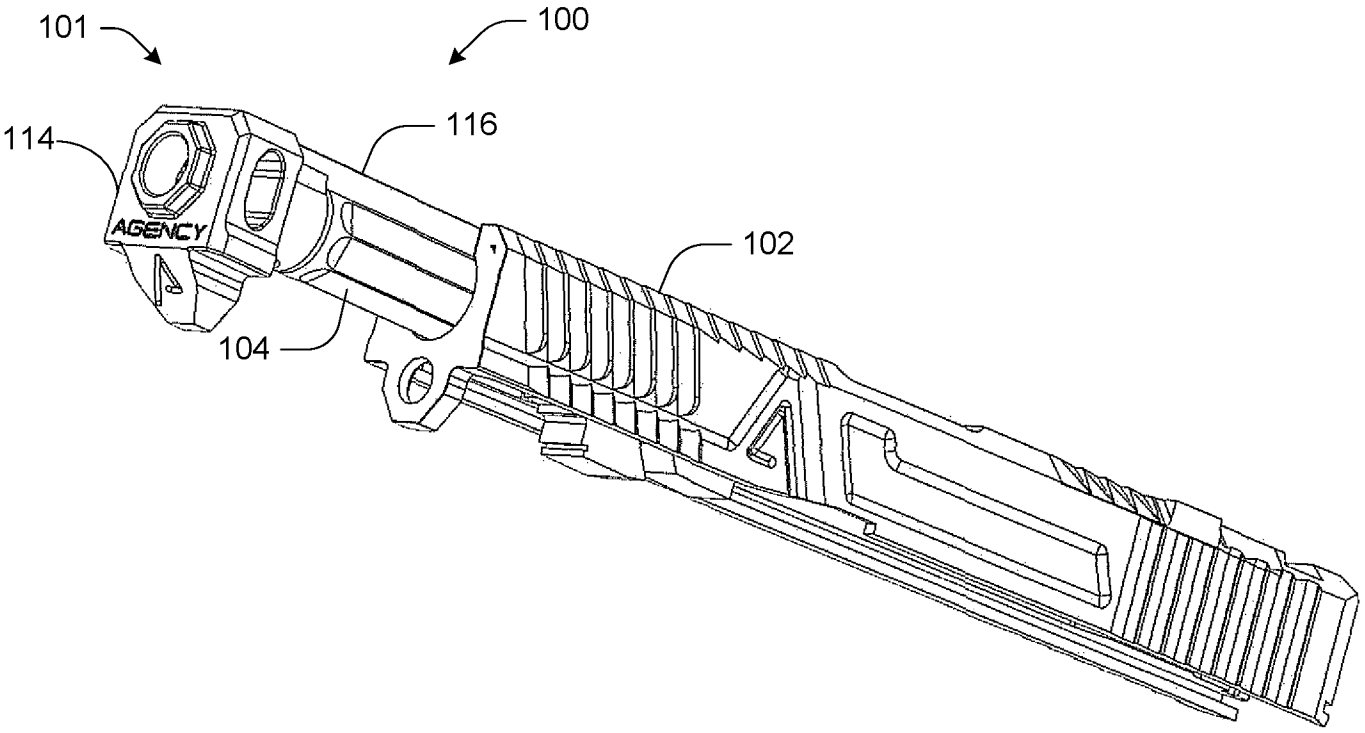
FIG. 2 depicts a lower view of a barrel attachment assembly in accordance with one or more embodiments of the disclosure.
Figure 3:
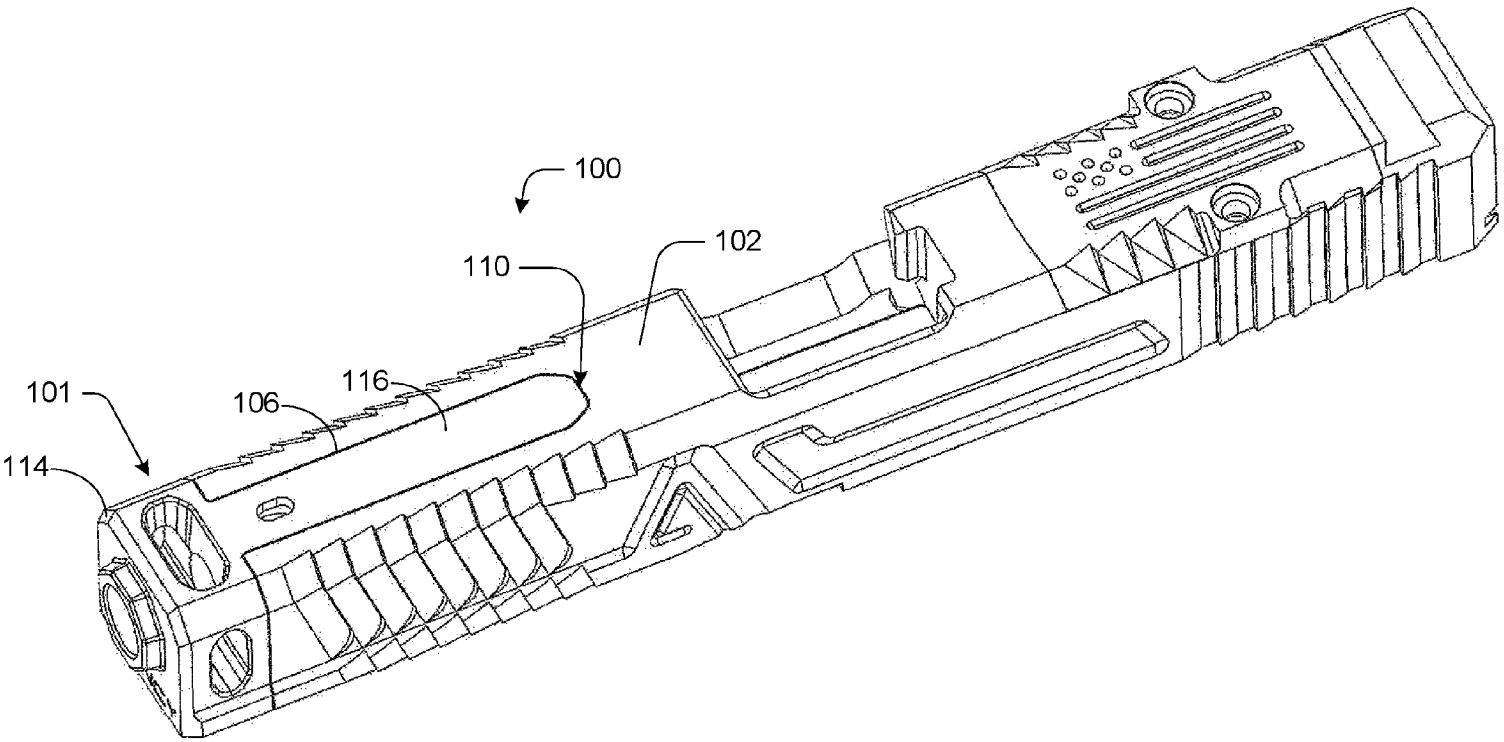
FIG. 3 depicts an upper view of a barrel attachment assembly in accordance with one or more embodiments of the disclosure.

FIGS. 1-3 depict a barrel attachment assembly 100. The barrel attachment assembly 100 may be incorporated into and/or attached to a firearm. The firearm may be a conventional firearm. For example, the firearm may be a handgun or the like. Any firearm may be used. The firearm may include, among other things, a slide 102 and a barrel 104.

The slide 102 may include a guide slot 106. In some instances, the guide slot 106 may be disposed on a top portion of the slide 102. The guide slot 106 may be disposed on any portion of the slide 102. The guide slot 106 may be any size, shape, or configuration. In certain embodiments, the guide slot 106 may be elongated, generally U-shaped, and include an open end 108 and an opposite closed end 110. In this manner, the guide slot 106 may be an elongated slot formed within the top of the slide 102. In some instances, the guide slot 106 may include a plurality of parallel slots formed within the top of the slide 102.

Figure 4:
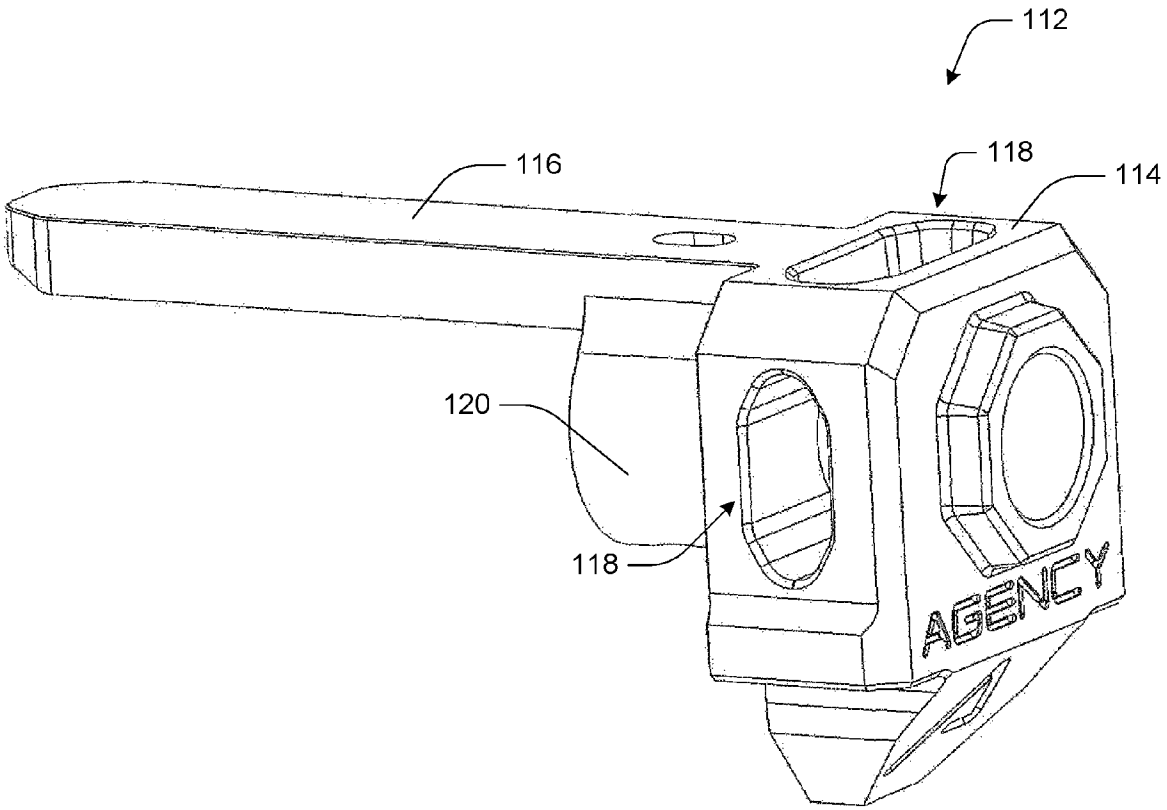
FIG. 4 depicts an upper view of a compensator in accordance with one or more embodiments of the disclosure.
Figure 5:
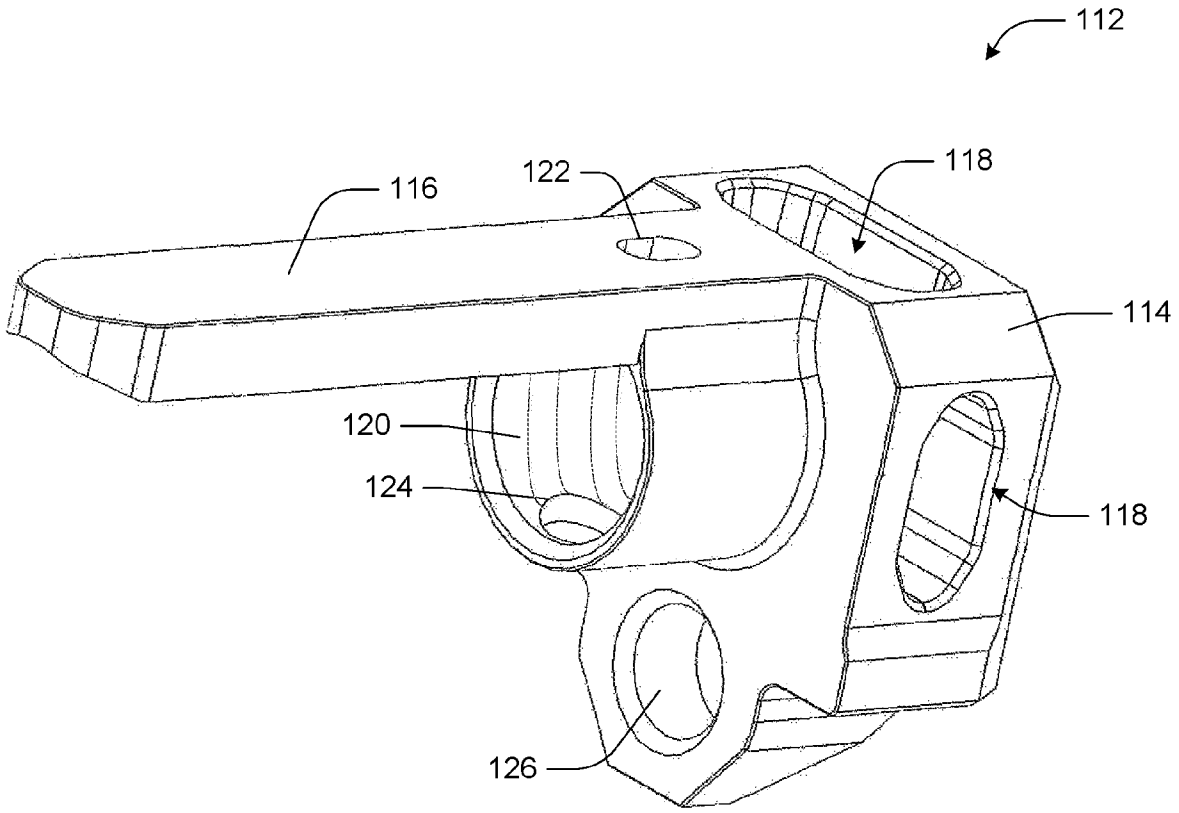
FIG. 5 depicts a rear view of a compensator in accordance with one or more embodiments of the disclosure.
Figure 6:
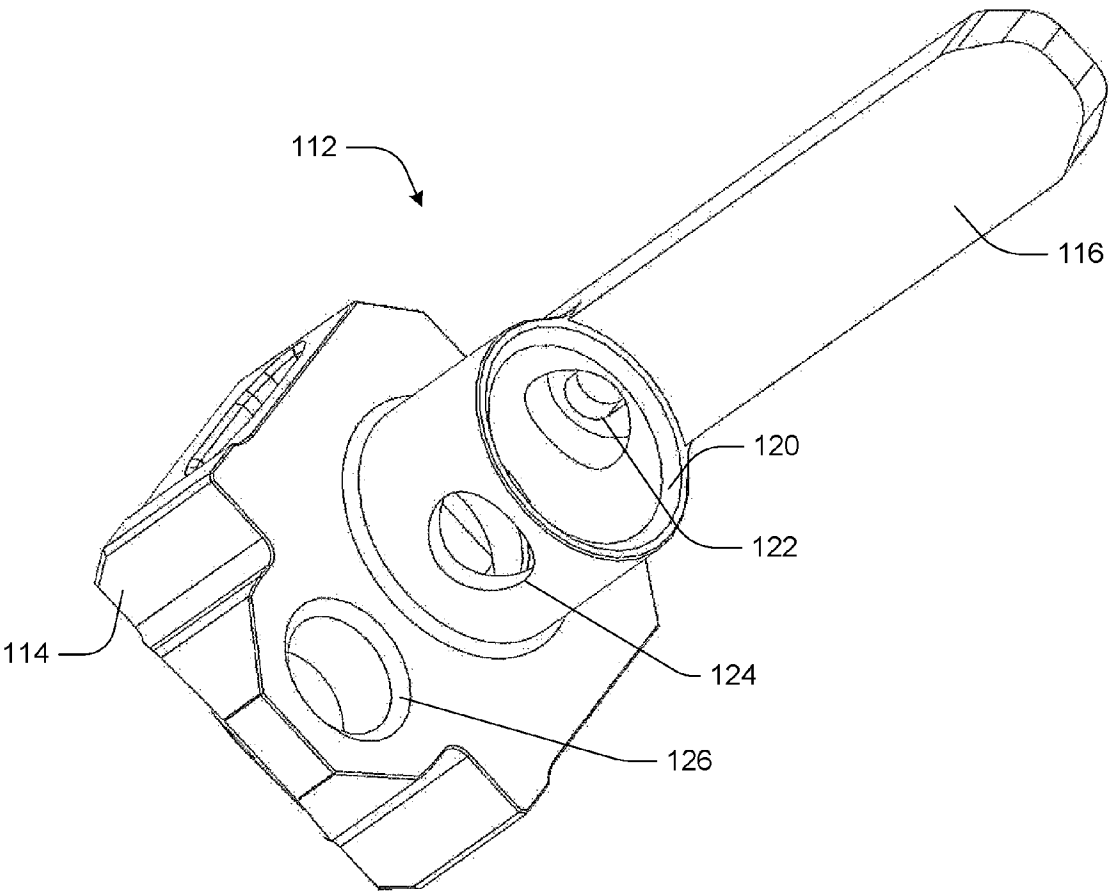
FIG. 6 depicts a lower view of a compensator in accordance with one or more embodiments of the disclosure.

The barrel attachment assembly 100 also may include a barrel attachment 101. As discussed below, the barrel attachment 101 may include several alternative embodiments. For example, the barrel attachment 101 may be a compensator, a weighted attachment, a flash hider, a quick detach mount, a threaded mount, or the like. In certain embodiments, the barrel attachment 101 may be a compensator 112. As depicted in FIGS. 4-6, the compensator 112 may include a main body 114 and an elongated guide beam 116. The main body 114 may be any size, shape, or configuration. In some instances, the main body 114 may be generally rectangular. The main body 114 may include one or more discharge ports 118. The main body 114 may include any number of discharge ports 118. The discharge ports 118 may be located anywhere on the main body 114, such as the top, bottom, sides, etc. The discharge ports 118 may be any size, shape, or configuration. The main body 114 may be any type of compensator.

In some instances, the interface between the main body 114 and the slide 102 may include an indexing device. For example, a tapered post may stick off the face of the main body 114 towards the slide 102. The tapered post may be configured to mate with a bore machine into an end of the slide 102. In a similar embodiment, the main body 114 may include guide teeth so that the main body 114 and barrel 104 are unable to move (e.g., wiggle) up or down because the guide teeth on the side of the slide 102 and the back of the main body 114 engage one another. Any type of indexing feature may be used, including protrusion, posts, bores, teeth, detents, or the like.

The elongated guide beam 116 may extend rearward from a top portion of the main body 114. The elongated guide beam 116 may extend from any portion of the main body 114. The elongated guide beam 116 may be any size, shape, or configuration. For example, the guide beam 116 may be rectangular and extend from the top or sides of the slide 102. The elongated guide beam 116 may be integrally formed with the main body 114. That is, the main body 114 and the elongated guide beam 116 may be one piece. In other instances, the elongated guide beam 116 and main body 114 may be two separate components that can be fastened together. In some instances, the elongated guide beam 116 may be configured to slidably nest within the guide slot 106. In this manner, the elongated guide beam 116 may be configured to slide within the guide slot 106 when the firearm is discharged, for example, as the slide 102 recoils rearward. The elongated guide beam 116 may have a suitable length such that the elongated guide beam 116 is at least partially maintained within the guide slot 106 when the firearm is discharged. The elongated guide beam 116 may comprise a plurality of guide beams which may be in parallel arrangement with respect to one another. In certain embodiments, with multiple elongated guide beams 116, only one of the beams 116 needs to be of a length suitable to remain in its corresponding guide slot during the discharge of the firearm. The guide slot 106 may include a complimentary configuration to the elongated guide beam 116. The elongated guide beam 116 and the guide slot 106 may maintain the compensator 112 in the proper alignment before, during, and after discharging the firearm. For example, the discharge ports 118 may have a desired alignment for recoil management of the firearm during discharge, and such alignment, also referred to as timing, may be maintained by the elongated guide beam 116 being at least partially disposed within the guide slot 106 during discharge of the firearm, thereby preventing rotation of the main body 114.

In some instances, the compensator 112 may include a barrel attachment bore 120 disposed below the elongated guide beam 116. The barrel attachment bore 120 may include internal threads or the like. FIG. 5 shows the barrel attachment bore 120 with threads; the threads are omitted in the other figures for simplicity and clarity. In this manner, the barrel attachment bore 120 may be threaded onto an end (i.e., the muzzle) of the barrel 104. That is, an end of the barrel 104 may include external threads that the barrel attachment bore 120 may be threaded on. When attached to the muzzled of the barrel 104, the barrel attachment bore 120 may be disposed within the slide 102 when the firearm 100 is in the repose position (i.e., before the firearm 100 is discharged), as depicted in FIG. 3. In this manner, the muzzle of the barrel 104 may be disposed within the slide 102 before the firearm is discharged.

When the compensator 112 is attached to the barrel 104, the elongated guide beam 116 may be disposed adjacent to and/or abut a top portion of the barrel 104 and extend along a length of the barrel 104 along the top thereof. The compensator 112 may be attached to the barrel 104 in any manner, including, but not limited to, compression fitted, clipped, latched, bolted, screwed, pinned, quick detached, welded, or the like. In some instances, the compensator 112 may be integrally formed with the barrel 104. That is, the barrel 104 and the compensator 112 may be a single piece. The compensator 112 may be detachably screwed to the barrel 104, but may not require a torque fit because the guide slot 106 and guide beam 116 may keep the compensator 112 from unscrewing.

The compensator 112 also may include a sight attachment hole 122 through the barrel attachment bore 120 and the elongated guide beam 116. A sight, or other aiming device, may be disposed within and/or secured to the sight attachment hole 122. In this manner, in some instances, the sight attachment hole 122 may include internal threads. The compensator 112 also may include a sight attachment access port 124 through the barrel attachment bore 120. The sight attachment access port 124 may enable tool access for positioning a sight in the sight attachment hole 122. In addition, the compensator 112 may include a recoil spring end cap cavity 126 extending downward from the main body 114. The recoil spring end cap cavity 126 may receive an end cap of a recoil spring. The top surface of the compensator 112 may include a dovetail for attaching a sight thereto.

In some embodiments, the compensator 112 may be removed or detached from the barrel 104 for field stripping the firearm. For instance, in an illustrative embodiment, once the slide 102 is removed from the lower portion of the firearm, also referred to as the grip, and the recoil spring removed, the barrel 104 may be extended forward such that the elongated guide beam 116 is not disposed within the guide slot 106. In such a position, the compensator 112 can be unscrewed and/or otherwise removed from the barrel 104 and the barrel 104 removed from the slide 102 for cleaning. This removal of the compensator 112 may be done without the assistance of a tool. All of the embodiments disclosed herein, including the weighted attachment, the flash hider, the quick detach assembly, and the threaded assembly, may be removed in a similar fashion.

Figure 7:
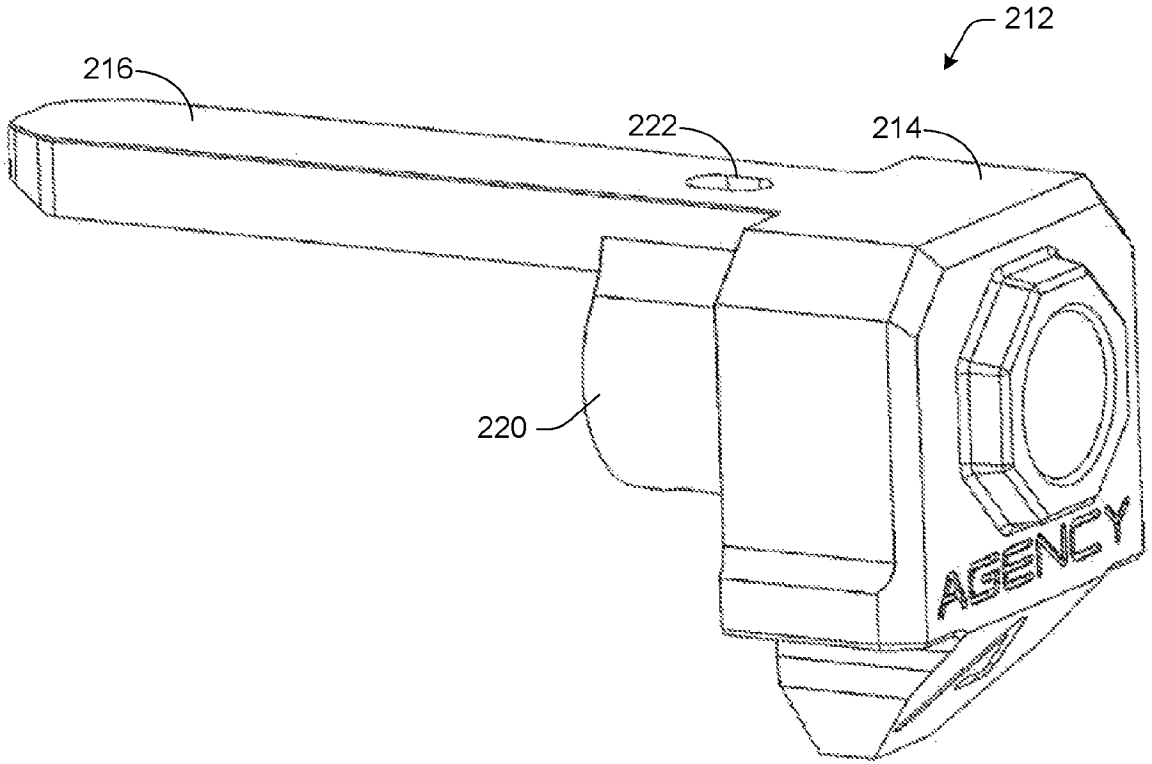
FIG. 7 depicts an upper view of a weighted attachment in accordance with one or more embodiments of the disclosure.
Figure 8:
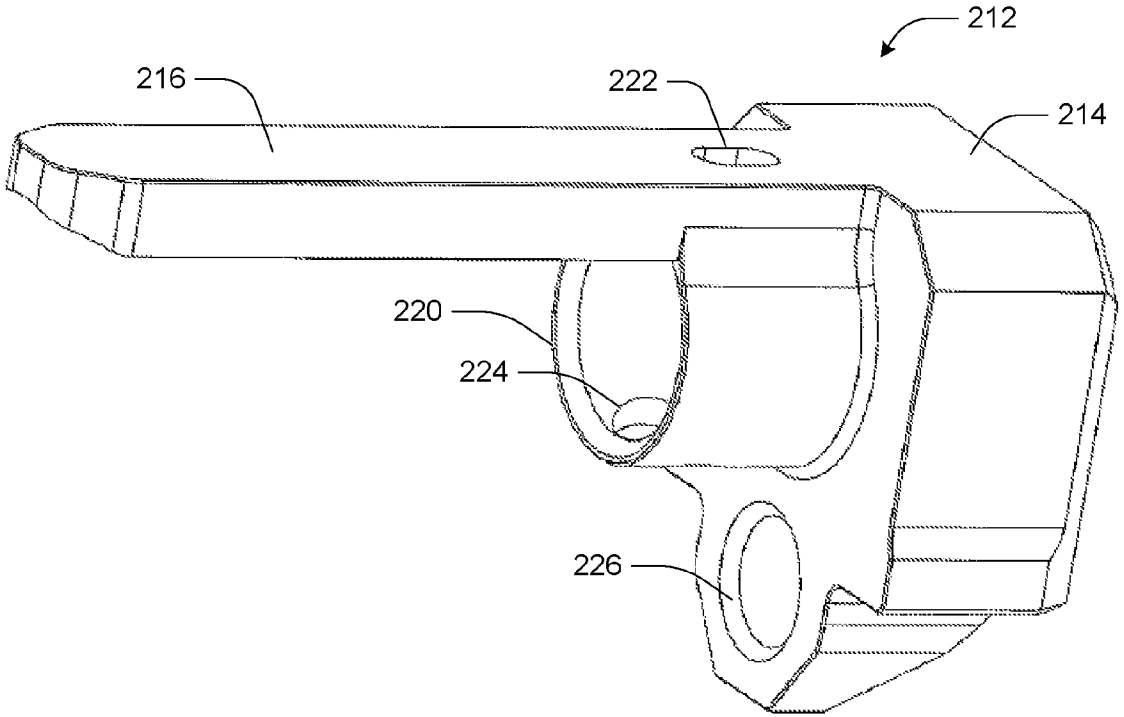
FIG. 8 depicts a rear view of a weighted attachment in accordance with one or more embodiments of the disclosure.
Figure 9:
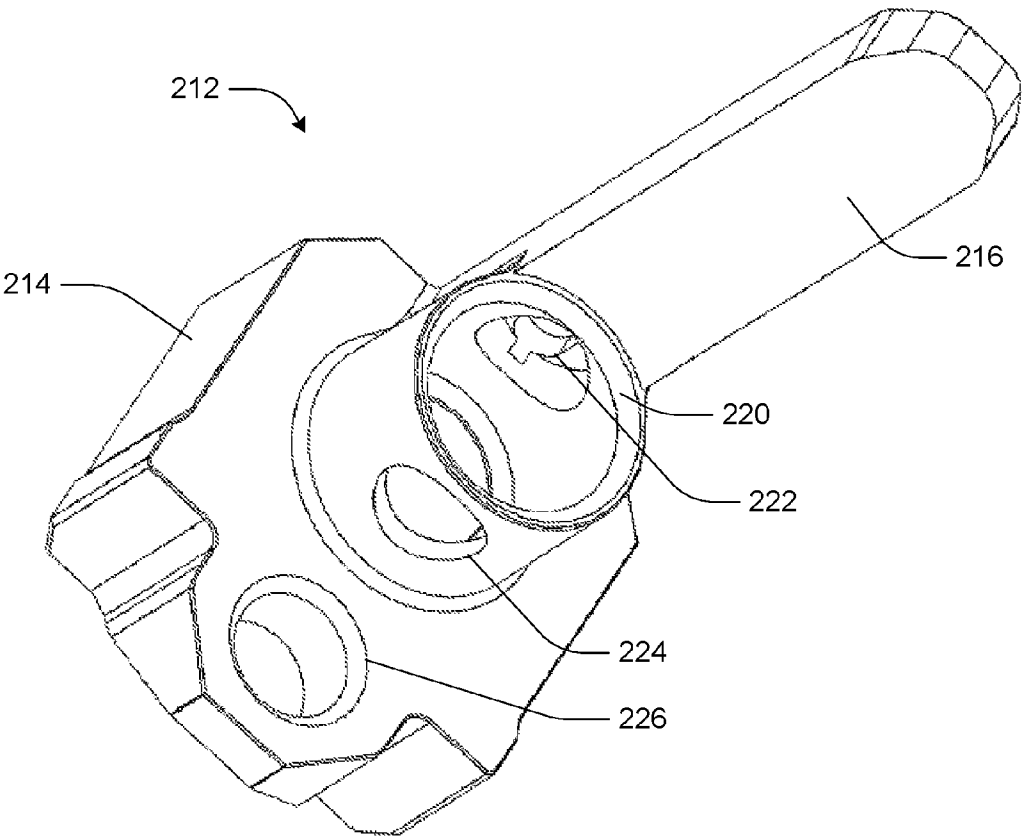
FIG. 9 depicts a lower view of a weighted attachment in accordance with one or more embodiments of the disclosure.

In another embodiment, as depicted in FIGS. 7-9, the barrel attachment 101 may include a weighted attachment 212. The weighted attachment 212 may provide additional weight to the muzzle end of the barrel 104. The weighted attachment 212 may include a main body 214 and one or more elongated guide beams 216. The main body 214 may be any size, shape, or configuration. In some instances, the main body 214 may be generally rectangular. The main body 214 may be a solid body with no discharge ports, or alternatively, it may include discharge ports that operate as a compensator and/or a flash hider. In another embodiment, the main body 214 may include an attachment device, such as a threaded extension or a quick detach extension.

In some instances, the interface between the main body 214 and the slide 102 may include an indexing device. For example, a tapered post may stick off the face of the main body 214 towards the slide 102. The tapered post may be configured to mate with a bore machine into an end of the slide 102. In a similar embodiment, the main body 214 may include guide teeth so that the main body 214 and barrel 104 are unable to move (e.g., wiggle) up or down because the guide teeth on the side of the slide 102 and the back of the main body 214 engage one another. Any type of indexing feature may be used, including protrusion, posts, bores, teeth, detents, or the like.

The elongated guide beam 216 may extend rearward from a top portion of the main body 214. The elongated guide beam 216 may extend from any portion of the main body 214. The elongated guide beam 216 may be any size, shape, or configuration. The elongated guide beam 216 may be integrally formed with the main body 214. That is, the main body 214 and the elongated guide beam 216 may be one piece. In other instances, the elongated guide beam 216 and main body 214 may be two separate components that can be fastened together. In some instances, the elongated guide beam 216 may be configured to slidably nest within the guide slot 106. In this manner, the elongated guide beam 216 may be configured to slide within the guide slot 106 when the firearm is discharged, for example, as the slide 102 recoils rearward. The elongated guide beam 216 may have a suitable length such that the elongated guide beam 216 is at least partially maintained within the guide slot 106 when the firearm is discharged. The elongated guide beam 216 may comprise a plurality of guide beams which may be in parallel arrangement with respect to one another. The guide slot 106 may include a complimentary configuration. The elongated guide beam 216 and the guide slot 106 may maintain the weighted attachment 212 in the proper alignment before, during, and after discharging the firearm.

In some instances, the weighted attachment 212 may include a barrel attachment bore 220 disposed below the elongated guide beam 216. The barrel attachment bore 220 may include internal threads or the like. In this manner, the barrel attachment bore 220 may be threaded onto an end (i.e., the muzzle) of the barrel 104. That is, an end of the barrel 104 may include external threads that the barrel attachment bore 220 may be threaded on. When attached to the muzzled of the barrel 104, the barrel attachment bore 220 may be disposed within the slide 102 when the firearm 100 is in the repose position (i.e., before the firearm 100 is discharged), as depicted in FIG. 3. In this manner, the muzzle of the barrel 104 may be disposed within the slide 102 before the firearm is discharged.

When the weighted attachment 212 is attached to the barrel 104, the elongated guide beam 216 may be disposed adjacent to and/or abut a top portion of the barrel 104 and extend along a length of the barrel 104 along the top thereof. The weighted attachment 212 may be attached to the barrel 104 in any manner, including, but not limited to, compression fitted, clipped, latched, bolted, screwed, pinned, quick detached, welded, or the like. In some instances, the weighted attachment 212 may be integrally formed with the barrel 104. That is, the barrel 104 and the weighted attachment 212 may be a single piece. The weighted attachment 212 may be detachably screwed to the barrel 104, but may not require a torque fit because the guide slot 106 and guide beam 216 keep the weighted attachment 212 from unscrewing.

The weighted attachment 212 also may include a sight attachment hole 222 through the barrel attachment bore 220 and the elongated guide beam 216. A sight, or other aiming device, may be disposed within and/or secured to the sight attachment hole 222. In this manner, in some instances, the sight attachment hole 222 may include internal threads. The weighted attachment 212 also may include a sight attachment access port 224 through the barrel attachment bore 220. The sight attachment access port 224 may enable tool access for positioning a sight in the sight attachment hole 222. In addition, the weighted attachment 212 may include a recoil spring end cap cavity 226 extending downward from the main body 214. The recoil spring end cap cavity 226 may enable a recoil spring end cap on the slide 102 to nest therein. The top surface of the weighted attachment 212 may include a dovetail for attaching a sight thereto.

Figure 10:
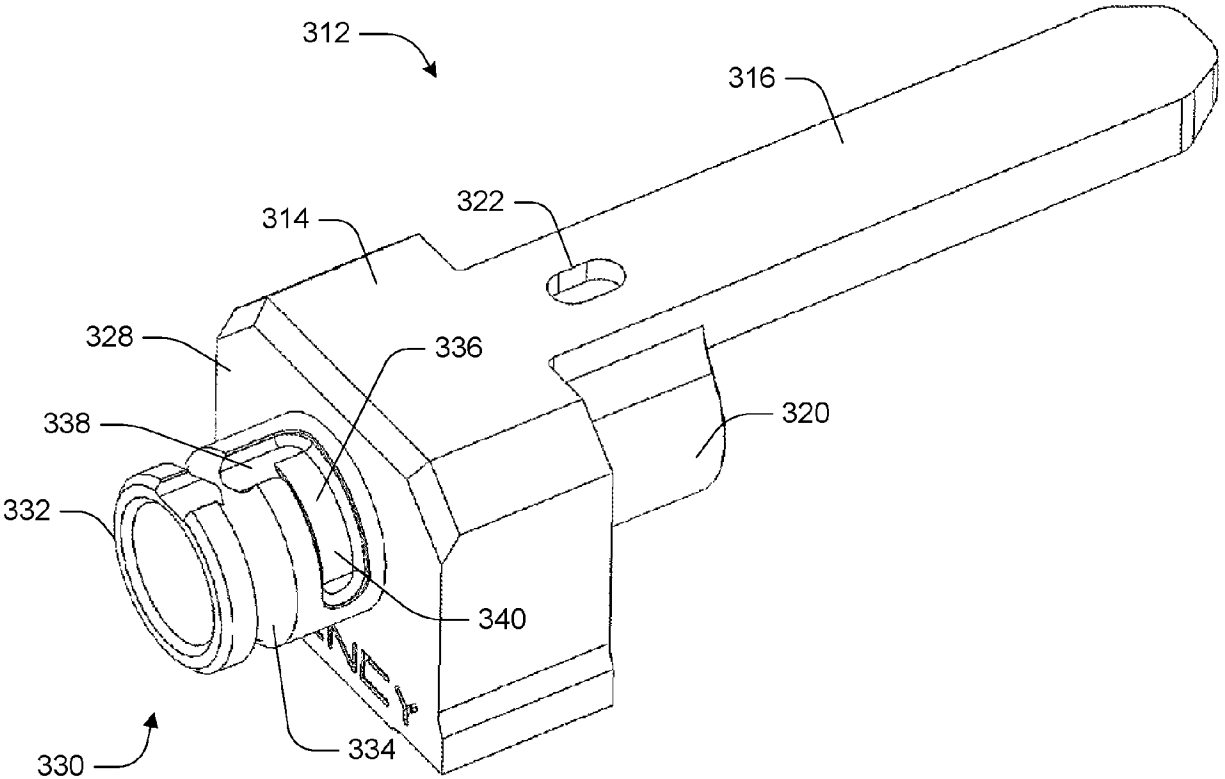
FIG. 10 depicts an upper view of a quick detach mounting system in accordance with one or more embodiments of the disclosure.
Figure 11:
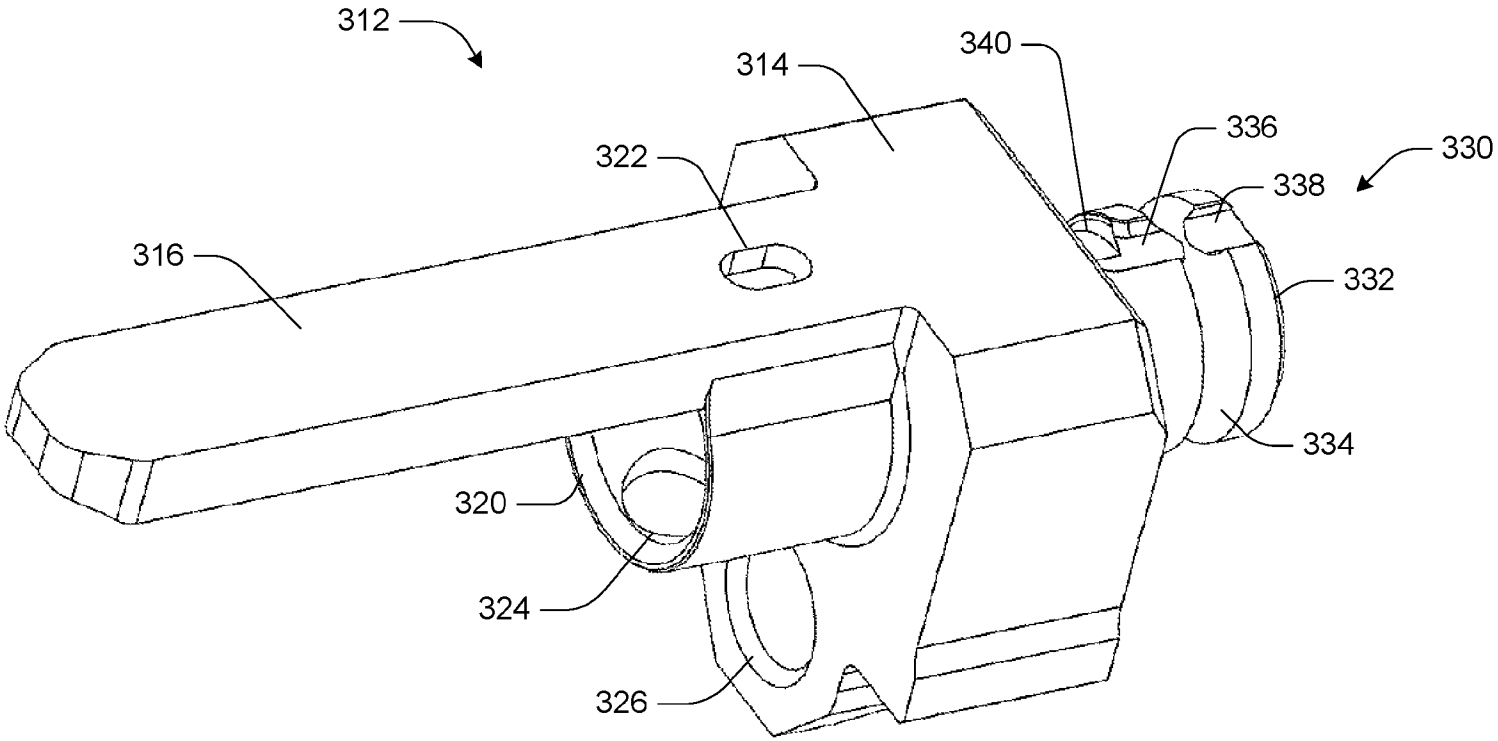
FIG. 11 depicts a rear view of a quick detach mounting system in accordance with one or more embodiments of the disclosure.
Figure 12:
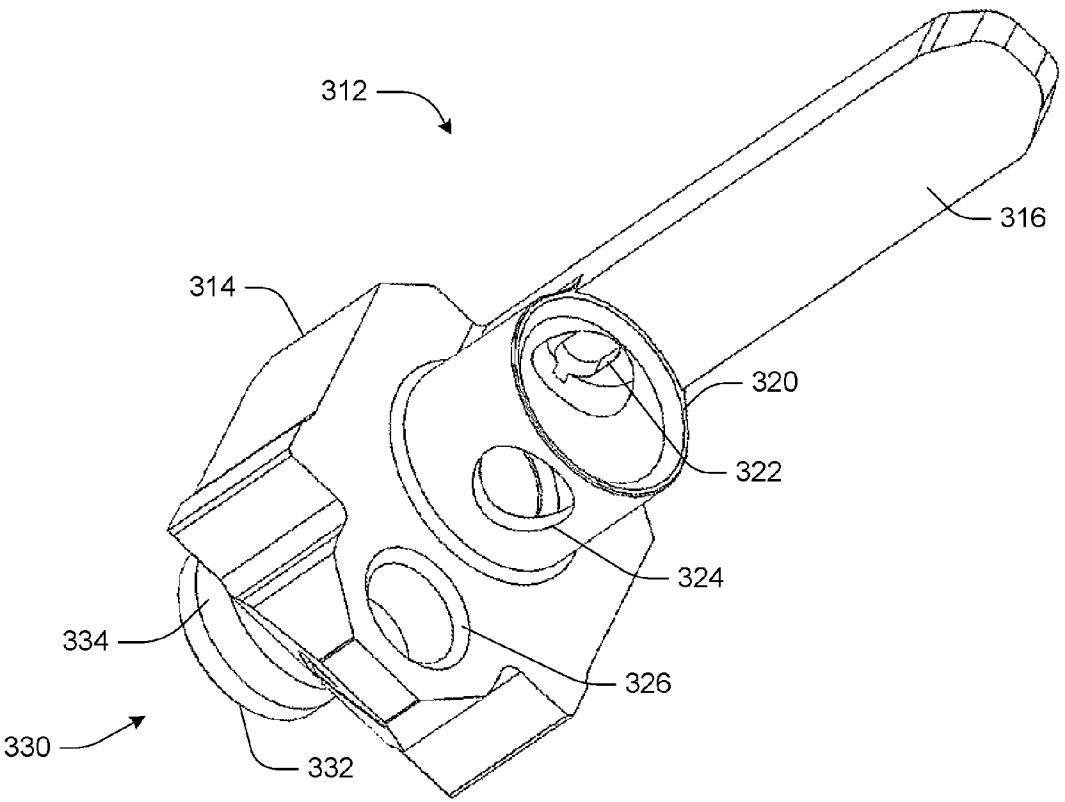
FIG. 12 depicts a lower view of a quick detach mounting system in accordance with one or more embodiments of the disclosure.
Figure 13:
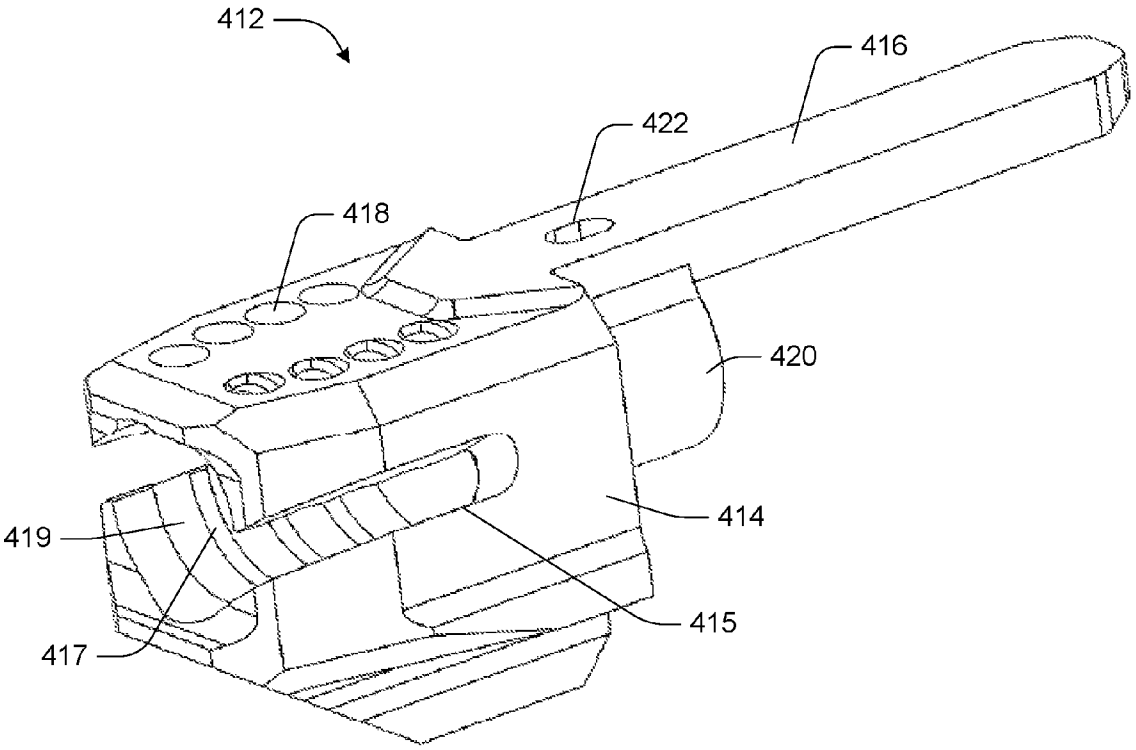
FIG. 13 depicts an upper view of a quick detach mounting system in accordance with one or more embodiments of the disclosure.
Figure 14:
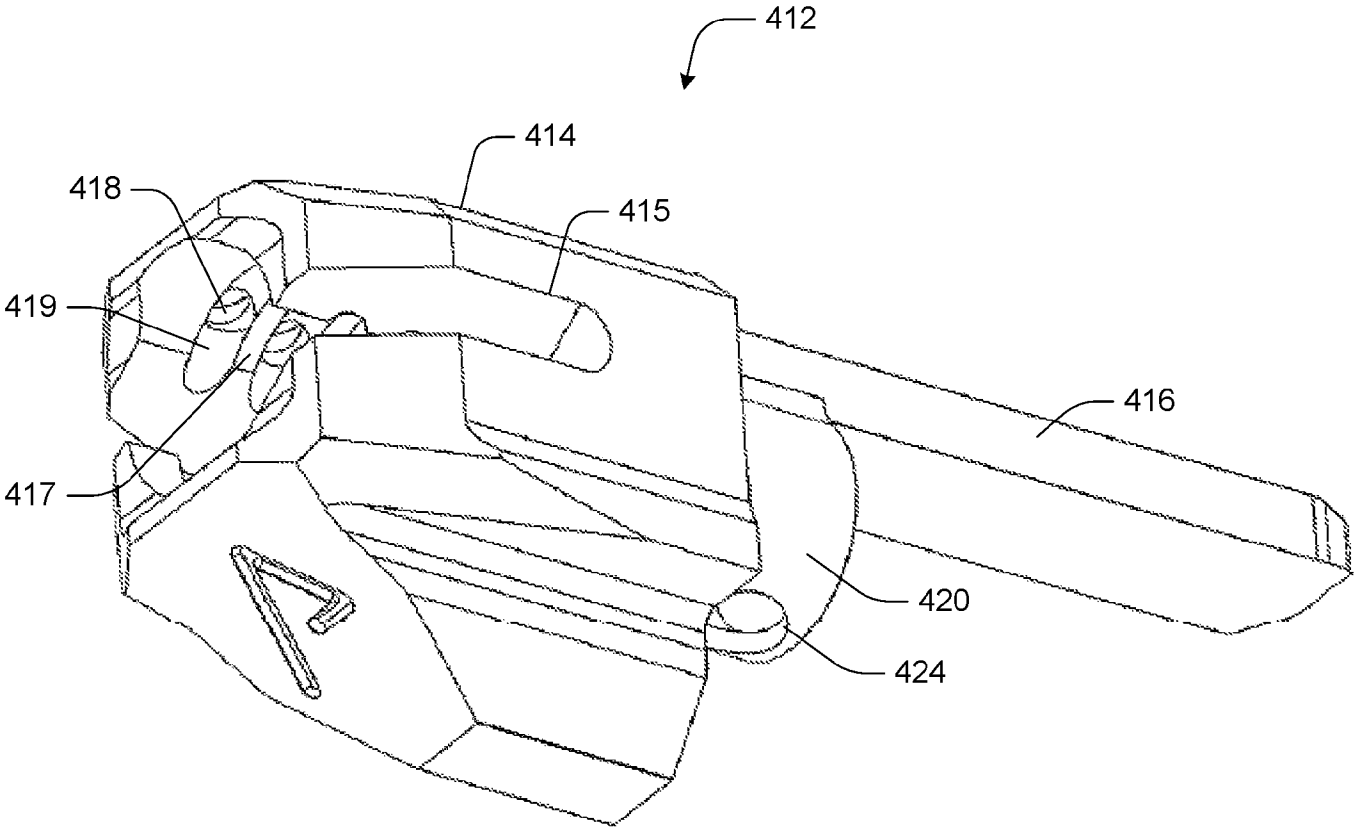
FIG. 14 depicts an upper view of a flash hider in accordance with one or more embodiments of the disclosure.
Figure 15:
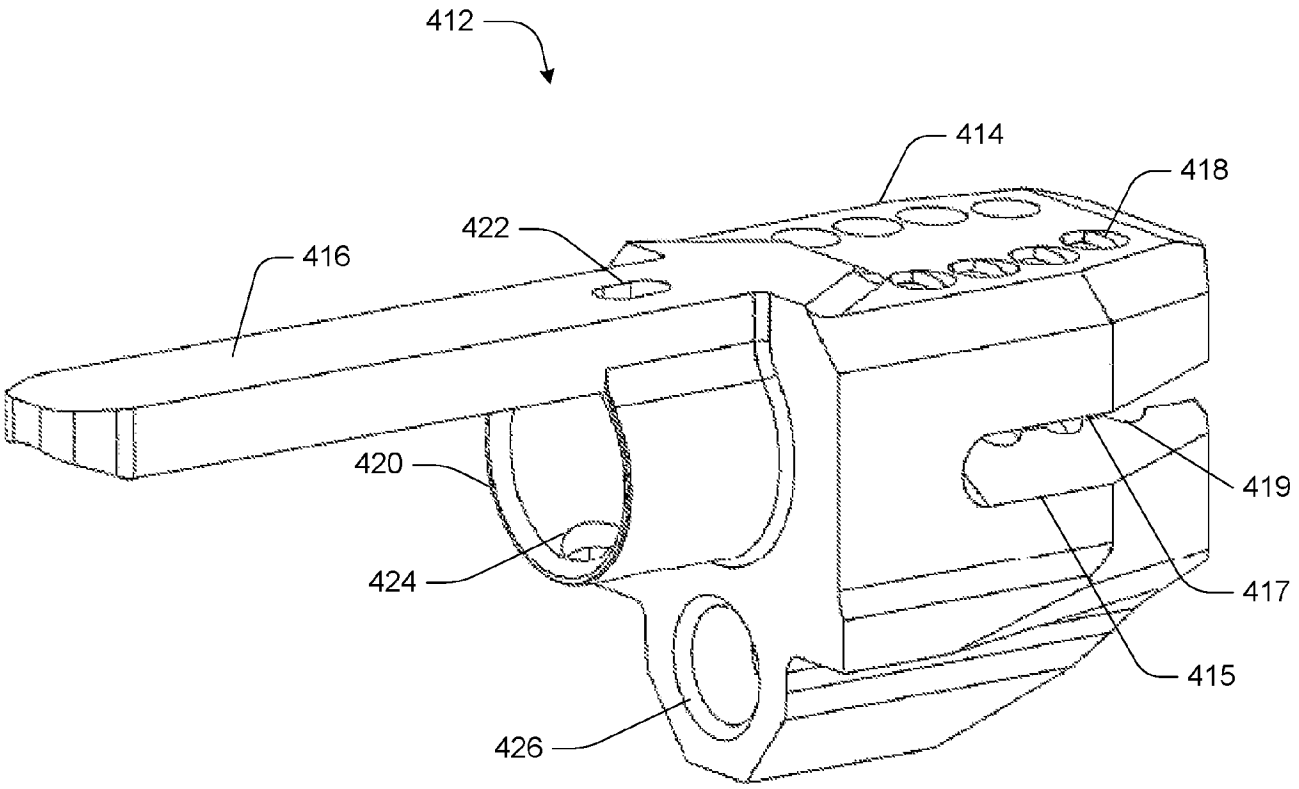
FIG. 15 depicts a rear view of a flash hider in accordance with one or more embodiments of the disclosure.
Figure 16:
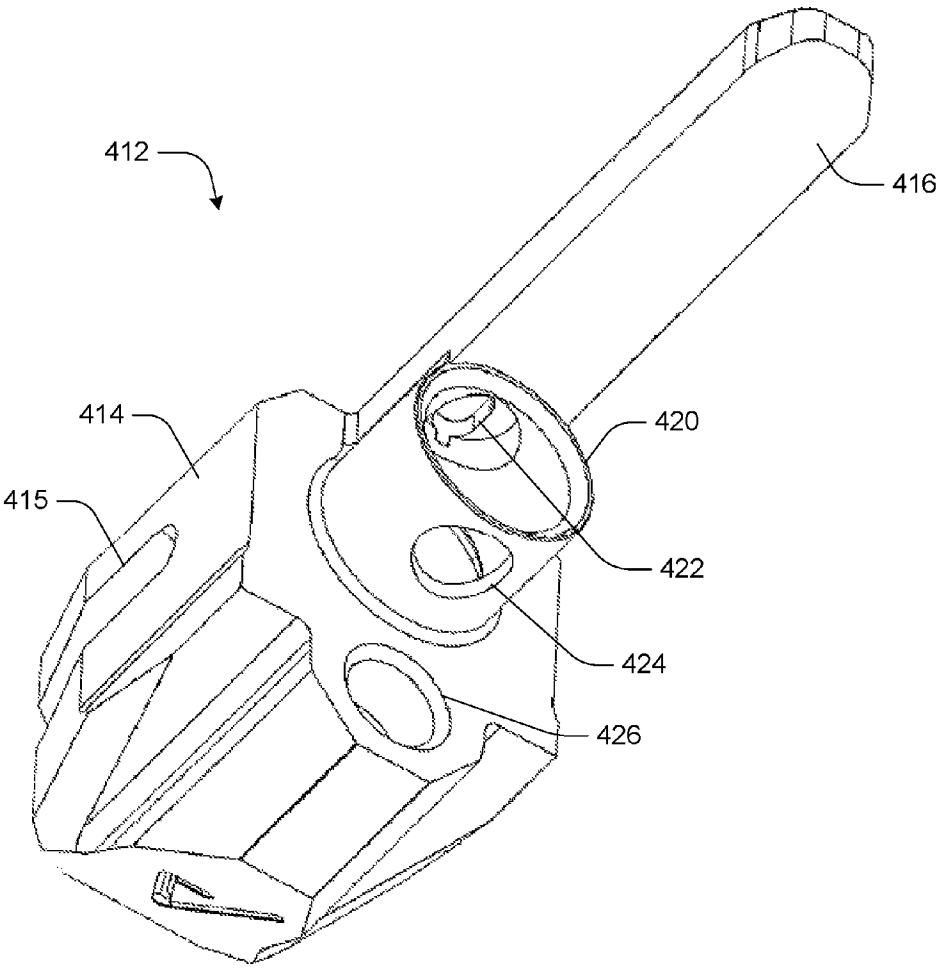
FIG. 16 depicts a lower view of a flash hider in accordance with one or more embodiments of the disclosure.

In another embodiment, as depicted in FIGS. 10-12, the barrel attachment 101 may include a quick detach barrel attachment 312. The quick detach barrel attachment 312 may include a main body 314 and an elongated guide beam 316. The main body 314 may be any size, shape, or configuration. In some instances, the main body 314 may be generally rectangular. The main body 314 may be a solid body with or without discharge ports.

In some instances, the interface between the main body 314 and the slide 102 may include an indexing device. For example, a tapered post may stick off the face of the main body 314 towards the slide 102. The tapered post may be configured to mate with a bore machine into an end of the slide 102. In a similar embodiment, the main body 314 may include guide teeth so that the main body 314 and barrel 104 is unable to move (e.g., wiggle) up or down because the guide teeth on the side of the slide 102 and the back of the main body 314 engage one another. Any type of indexing feature may be used, including protrusion, posts, bores, teeth, detents, or the like.

The elongated guide beam 316 may extend rearward from a top portion of the main body 314. The elongated guide beam 316 may extend from any portion of the main body 314. The elongated guide beam 316 may be any size, shape, or configuration. The elongated guide beam 316 may be integrally formed with the main body 314. That is, the main body 314 and the elongated guide beam 316 may be one piece. In other instances, the elongated guide beam 316 and main body 314 may be two separate components that can be fastened together. In some instances, the elongated guide beam 316 may be configured to slidably nest within the guide slot 106. In this manner, the elongated guide beam 316 may be configured to slide within the guide slot 106 when the firearm is discharged, for example, as the slide 102 recoils rearward. The elongated guide beam 316 may have a suitable length such that the elongated guide beam 316 is at least partially maintained within the guide slot 106 when the firearm is discharged. The elongated guide beam 316 may comprise a plurality of guide beams which may be in parallel arrangement with respect to one another. The guide slot 106 may include a complimentary configuration. The elongated guide beam 316 and the guide slot 106 may maintain the quick detach barrel attachment 312 in the proper alignment before, during, and after discharging the firearm.

In some instances, the quick detach barrel attachment 312 may include a barrel attachment bore 320 disposed below the elongated guide beam 316. The barrel attachment bore 320 may include internal threads or the like. In this manner, the barrel attachment bore 320 may be threaded onto an end (i.e., the muzzle) of the barrel 104. That is, an end of the barrel 104 may include external threads that the barrel attachment bore 320 may be threaded on. When attached to the muzzled of the barrel 104, the barrel attachment bore 320 may be disposed within the slide 102 when the firearm 100 is in the repose position (i.e., before the firearm 100 is discharged), as depicted in FIG. 3. In this manner, the muzzle of the barrel 104 may be disposed within the slide 102 before the firearm is discharged.

When the quick detach barrel attachment 312 is attached to the barrel 104, the elongated guide beam 316 may be disposed adjacent to and/or abut a top portion of the barrel 104 and extend along a length of the barrel 104 along the top thereof. The quick detach barrel attachment 312 may be attached to the barrel 104 in any manner, including, but not limited to, compression fitted, clipped, latched, bolted, screwed, pinned, quick detached, welded, or the like. In some instances, the quick detach barrel attachment 312 may be integrally formed with the barrel 104. That is, the barrel 104 and the quick detach barrel attachment 312 may be a single piece. The quick detach barrel attachment 312 may be detachably screwed to the barrel 104, but may not require a torque fit because the guide slot 106 and guide beam 316 keep the quick detach barrel attachment 312 from unscrewing.

The quick detach barrel attachment 312 also may include a sight attachment hole 322 through the barrel attachment bore 320 and the elongated guide beam 316. A sight, or other aiming device, may be disposed within and/or secured to the sight attachment hole 322. In this manner, in some instances, the sight attachment hole 322 may include internal threads. The quick detach barrel attachment 312 also may include a sight attachment access port 324 through the barrel attachment bore 320. The sight attachment access port 324 may enable tool access for positioning a sight in the sight attachment hole 322. In addition, the quick detach barrel attachment 312 may include a recoil spring end cap cavity 326 extending downward from the main body 314. The recoil spring end cap cavity 326 may enable a recoil spring end cap on the slide 102 to nest therein. The top surface of the quick detach barrel attachment 312 may include a dovetail for attaching a sight thereto.

A front surface 328 of the main body 314 may include a quick detach assembly 330 extending therefrom. Any type of quick detach assembly may be used herein. The quick detach assembly 330 may enable various firearm components and/or accessories to be attached to the barrel attachment 101. For example, a compensator, a suppressor, a weight, a flash hider, or the like may be attached to the barrel attachment 101 using the quick detach assembly 330. In one example embodiment, the quick detach assembly 330 may include a tubular protrusion 332 extending from the front surface 328 of the main body 314. The tubular protrusion 332 may include a circular channel 334 on the outer surface thereof. In addition, the tubular protrusion 332 may include a slot 336 on the outer surface thereof. The slot 336 may include a first portion 338 extending from a front portion of the tubular protrusion 332 to a rear portion of the tubular protrusion 332. The slot 336 also may include a second portion 340 that is substantially transverse to the first portion 338 and extends partially about the circumference of the tubular protrusion 332.

In certain embodiments, the barrel attachment 101 may be a flash hider 412. As depicted in FIGS. 13-16, the flash hider 412 may include a main body 414 and an elongated guide beam 416. The main body 414 may be any size, shape, or configuration. In some instances, the main body 414 may be generally rectangular and include one or more chamfered surfaces. The main body 414 may include one or more discharge ports 418. The main body 414 may include any number of discharge ports 418. The discharge ports 418 may be located anywhere on the main body 414, such as the top, bottom, sides, etc. The discharge ports 418 may be any size, shape, or configuration. The main body 414 may be any type of flash hider. The main body 414 also may include side slots 415. Any number of side slots 415 may be used. The main body 414 also may include longitudinally spaced internal ribs 417. Any number of internal ribs 417 may be used. The internal ribs 417 may form channels 419 therebetween. The channels 419 formed between the internal ribs 417 may be in fluid communication with the discharge ports 418.

In some instances, the interface between the main body 414 and the slide 102 may include an indexing device. For example, a tapered post may stick off the face of the main body 414 towards the slide 102. The tapered post may be configured to mate with a bore machine into an end of the slide 102. In a similar embodiment, the main body 414 may include guide teeth so that the main body 414 and barrel 104 is unable to move (e.g., wiggle) up or down because the guide teeth on the side of the slide 102 and the back of the main body 414 engage one another. Any type of indexing feature may be used, including protrusion, posts, bores, teeth, detents, or the like.

The elongated guide beam 416 may extend rearward from a top portion of the main body 414. The elongated guide beam 416 may extend from any portion of the main body 414. The elongated guide beam 416 may be any size, shape, or configuration. The elongated guide beam 416 may be integrally formed with the main body 414. That is, the main body 414 and the elongated guide beam 416 may be one piece. In other instances, the elongated guide beam 416 and main body 414 may be two separate components that can be fastened together. In some instances, the elongated guide beam 416 may be configured to slidably nest within the guide slot 106. In this manner, the elongated guide beam 416 may be configured to slide within the guide slot 106 when the firearm is discharged, for example, as the slide 102 recoils rearward. The elongated guide beam 416 may have a suitable length such that the elongated guide beam 416 is at least partially maintained within the guide slot 106 when the firearm is discharged. The elongated guide beam 416 may comprise a plurality of guide beams which may be in parallel arrangement with respect to one another. The guide slot 106 may include a complimentary configuration. The elongated guide beam 416 and the guide slot 106 may maintain the flash hider 412 in the proper alignment before, during, and after discharging the firearm.

In some instances, the flash hider 412 may include a barrel attachment bore 420 disposed below the elongated guide beam 416. The barrel attachment bore 420 may include internal threads or the like. In this manner, the barrel attachment bore 420 may be threaded onto an end (i.e., the muzzle) of the barrel 104. That is, an end of the barrel 104 may include external threads that the barrel attachment bore 420 may be threaded on. When attached to the muzzled of the barrel 104, the barrel attachment bore 420 may be disposed within the slide 102 when the firearm 100 is in the repose position (i.e., before the firearm 100 is discharged), as depicted in FIG. 3. In this manner, the muzzle of the barrel 104 may be disposed within the slide 102 before the firearm is discharged.

When the flash hider 412 is attached to the barrel 104, the elongated guide beam 416 may be disposed adjacent to and/or abut a top portion of the barrel 104 and extend along a length of the barrel 104 along the top thereof. The flash hider 412 may be attached to the barrel 104 in any manner, including, but not limited to, compression fitted, clipped, latched, bolted, screwed, pinned, quick detached, welded, or the like. In some instances, the flash hider 412 may be integrally formed with the barrel 102. That is, the barrel 104 and the flash hider 412 may be a single piece. The flash hider 412 may be detachably screwed to the barrel 104, but may not require a torque fit because the guide slot 106 and guide beam 416 keep the flash hider 412 from unscrewing.

The flash hider 412 also may include a sight attachment hole 422 through the barrel attachment bore 420 and the elongated guide beam 416. A sight, or other aiming device, may be disposed within and/or secured to the sight attachment hole 422. In this manner, in some instances, the sight attachment hole 422 may include internal threads. The flash hider 412 also may include a sight attachment access port 424 through the barrel attachment bore 420. The sight attachment access port 424 may enable tool access for positioning a sight in the sight attachment hole 422. In addition, the flash hider 412 may include a recoil spring end cap cavity 426 extending downward from the main body 414. The recoil spring end cap cavity 426 may enable a recoil spring end cap on the slide 102 to nest therein. The top surface of the flash hider 412 may include a dovetail for attaching a sight thereto.

Figure 17:
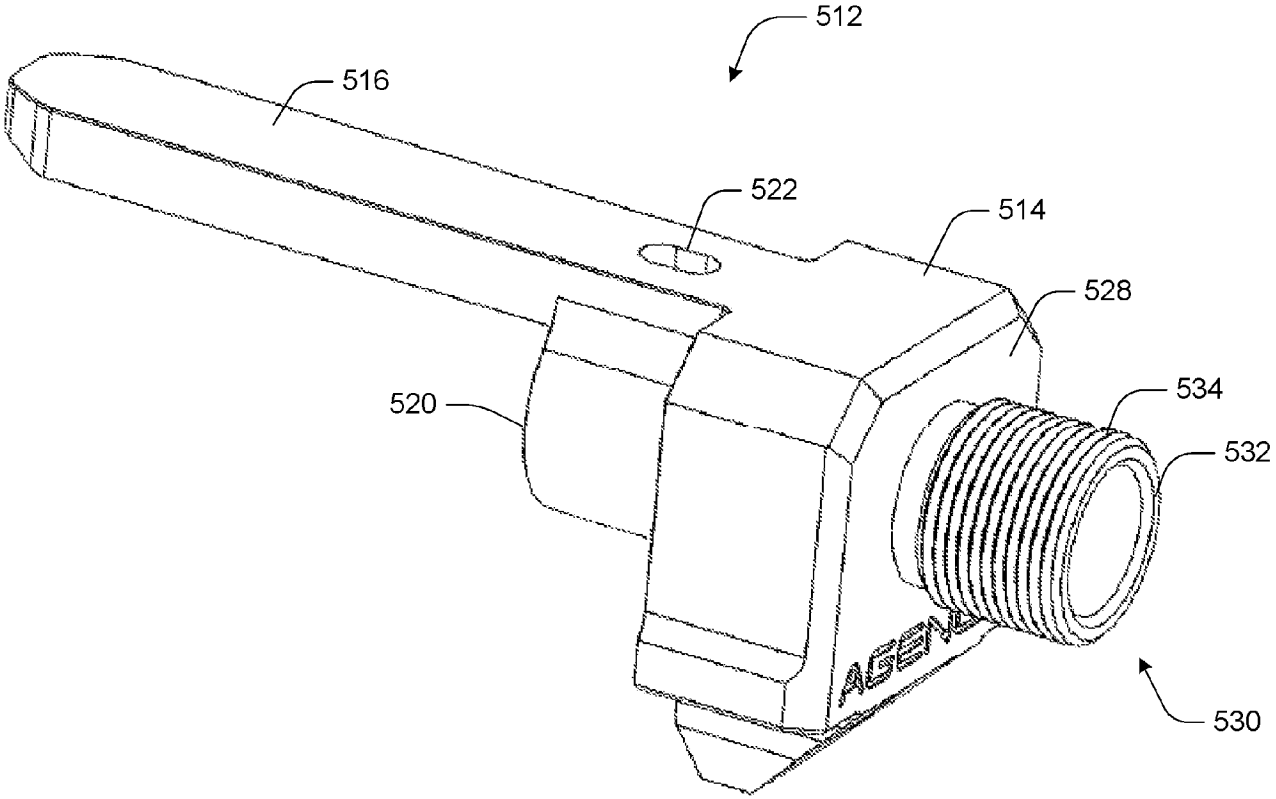
FIG. 17 depicts an upper view of a threaded mounting system in accordance with one or more embodiments of the disclosure.
Figure 18:
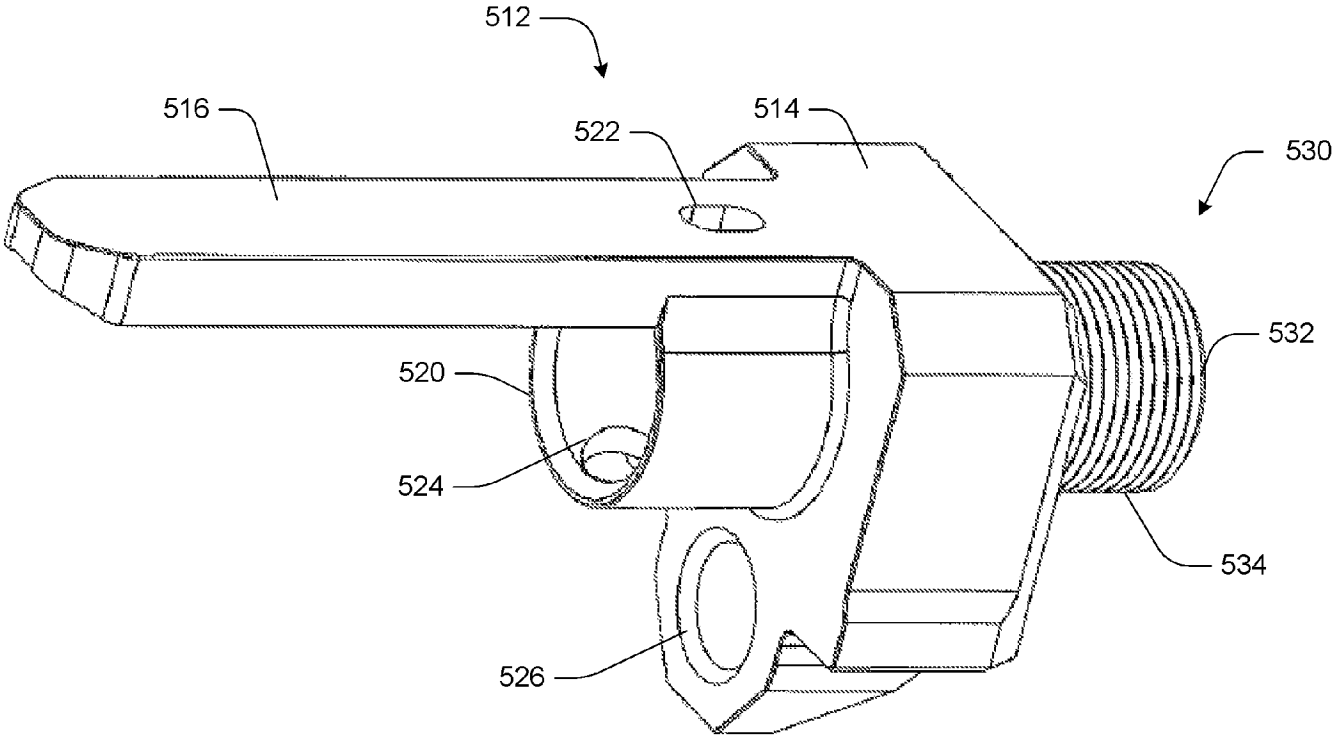
FIG. 18 depicts a rear view of a threaded mounting system in accordance with one or more embodiments of the disclosure.
Figure 19:
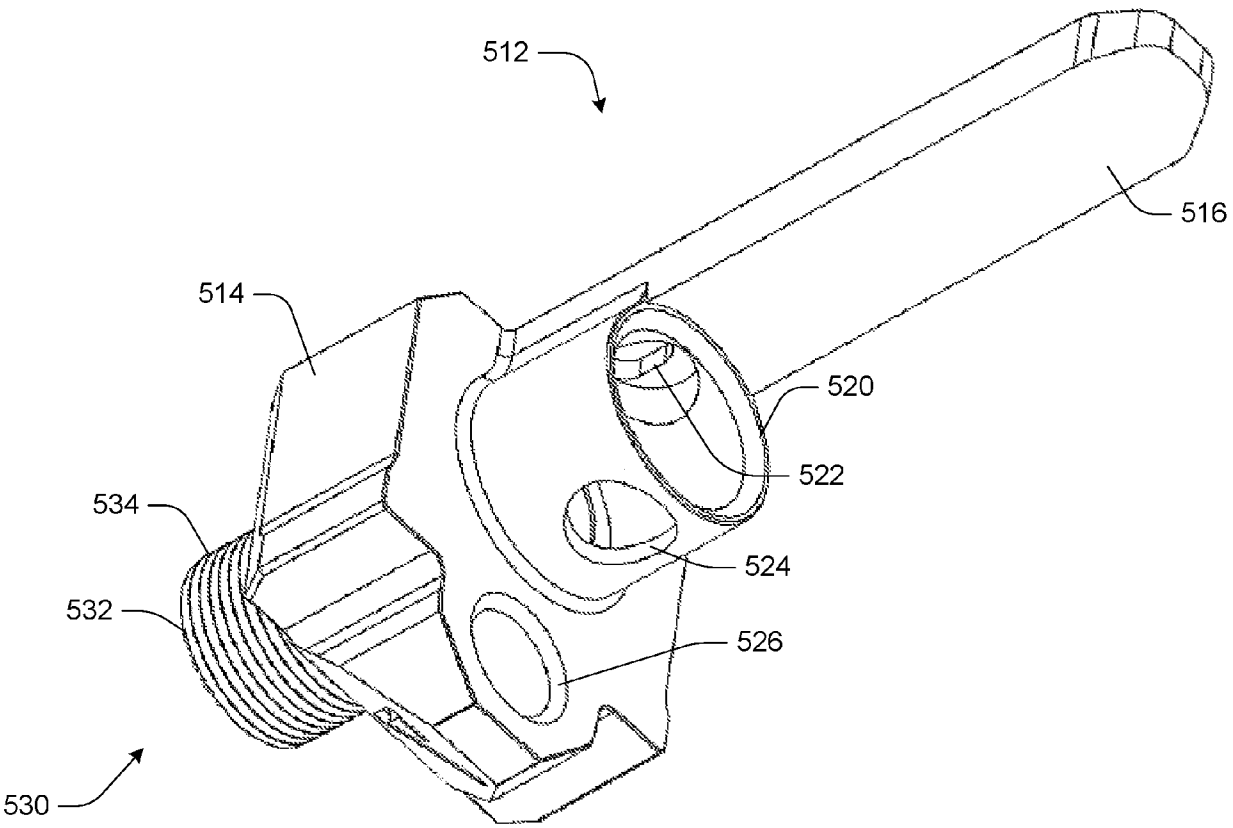
FIG. 19 depicts a lower view of a threaded mounting system in accordance with one or more embodiments of the disclosure.

In another embodiment, as depicted in FIGS. 17-19, the barrel attachment 101 may include a threaded barrel attachment 512. The threaded barrel attachment 512 may include a main body 514 and an elongated guide beam 516. The main body 514 may be any size, shape, or configuration. In some instances, the main body 514 may be generally rectangular. The main body 514 may be a solid body with or without discharge ports.

In some instances, the interface between the main body 514 and the slide 102 may include an indexing device. For example, a tapered post may stick off the face of the main body 514 towards the slide 102. The tapered post may be configured to mate with a bore machine into an end of the slide 102. In a similar embodiment, the main body 514 may include guide teeth so that the main body 514 and barrel 104 are unable to move (e.g., wiggle) up or down because the guide teeth on the side of the slide 102 and the back of the main body 514 engage one another. Any type of indexing feature may be used, including protrusion, posts, bores, teeth, detents, or the like.

The elongated guide beam 516 may extend rearward from a top portion of the main body 514. The elongated beam 516 may extend from any portion of the main body 514. The elongated guide beam 516 may be any size, shape, or configuration. The elongated guide beam 516 may be integrally formed with the main body 514. That is, the main body 514 and the elongated guide beam 516 may be one piece. In other instances, the elongated guide beam 516 and main body 514 may be two separate components that can be fastened together. In some instances, the elongated guide beam 516 may be configured to slidably nest within the guide slot 106. In this manner, the elongated guide beam 516 may be configured to slide within the guide slot 106 when the firearm is discharged, for example, as the slide 102 recoils rearward. The elongated guide beam 516 may have a suitable length such that the elongated guide beam 516 is at least partially maintained within the guide slot 106 when the firearm is discharged. The elongated guide beam 516 may comprise a plurality of guide beams which may be in parallel arrangement with respect to one another. The guide slot 106 may include a complimentary configuration. The elongated guide beam 516 and the guide slot 106 may maintain the threaded barrel attachment 512 in the proper alignment before, during, and after discharging the firearm.

In some instances, the threaded barrel attachment 512 may include a barrel attachment bore 520 disposed below the elongated guide beam 516. The barrel attachment bore 520 may include internal threads or the like. In this manner, the barrel attachment bore 520 may be threaded onto an end (i.e., the muzzle) of the barrel 104. That is, an end of the barrel 104 may include external threads that the barrel attachment bore 520 may be threaded on. When attached to the muzzled of the barrel 104, the barrel attachment bore 520 may be disposed within the slide 102 when the firearm 100 is in the repose position (i.e., before the firearm 100 is discharged), as depicted in FIG. 3. In this manner, the muzzle of the barrel 104 may be disposed within the slide 102 before the firearm is discharged.

When the threaded barrel attachment 512 is attached to the barrel 104, the elongated guide beam 516 may be disposed adjacent to and/or abut a top portion of the barrel 104 and extend along a length of the barrel 104 along the top thereof. The threaded barrel attachment 512 may be attached to the barrel 104 in any manner, including, but not limited to, compression fitted, clipped, latched, bolted, screwed, pinned, quick detached, welded, or the like. In some instances, the threaded barrel attachment 512 may be integrally formed with the barrel 104. That is, the barrel 104 and the threaded barrel attachment 512 may be a single piece. The threaded barrel attachment 512 may be detachably screwed to the barrel 104, but may not require a torque fit because the guide slot 106 and guide beam 516 keep the threaded barrel attachment 512 from unscrewing.

The threaded barrel attachment 512 also may include a sight attachment hole 522 through the barrel attachment bore 520 and the elongated guide beam 516. A sight, or other aiming device, may be disposed within and/or secured to the sight attachment hole 522. In this manner, in some instances, the sight attachment hole 522 may include internal threads. The threaded barrel attachment 512 also may include a sight attachment access port 524 through the barrel attachment bore 520. The sight attachment access port 524 may enable tool access for positioning a sight in the sight attachment hole 522. In addition, the threaded barrel attachment 512 may include a recoil spring end cap cavity 526 extending downward from the main body 514. The recoil spring end cap cavity 526 may enable a recoil spring end cap on the slide 102 to nest therein. The top surface of the threaded barrel attachment 512 may include a dovetail for attaching a sight thereto.

A front surface 528 of the main body 514 may include a threaded attachment assembly 530 extending therefrom. Any type of threaded attachment assembly may be used herein. The threaded attachment assembly 530 may enable various firearm components and/or accessories to be attached to the barrel attachment 101. For example, a compensator, a weight, a suppressor, a flash hider, or the like may be attached to the barrel attachment 101 using the threaded attachment assembly 530. In one example embodiment, the threaded attachment assembly 530 may include a tubular protrusion 532 extending from the front surface 528 of the main body 514. The tubular protrusion 532 may include a threaded exterior surface 534. In this manner, components and/or accessories may be threaded onto the tubular protrusion 532.

Figure 20:
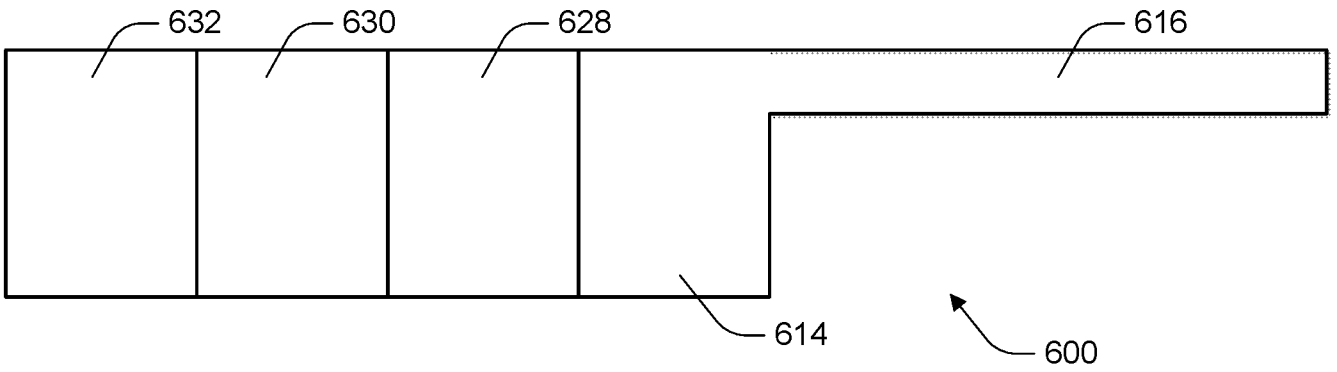
FIG. 20 depicts a barrel attachment assembly in accordance with one or more embodiments of the disclosure.

FIG. 20 schematically depicts a barrel attachment 600 including a number of components and/or accessories attached thereto. Like all of the barrel attachments discussed above, the barrel attachment 600 may include a main body 614 and an elongated guide beam 616. The main body 614 and the guide beam 616 may be attached to a firearm in a similar manner as described above. The barrel attachment 600 may include all or some of the components discussed above. For simplicity, however, the barrel attachment bore, the sight attachment hole, the dovetail, and/or the sight access port are not shown. The barrel attachment 600 may be a compensator, a flash hider, a weighted attachment, a threaded attachment assembly, or the like. In addition, additional firearm components and/or accessories may be attached to the barrel attachment 600. For example, a first component 628, a second component 630, and/or a third component 632 may be attached to the barrel attachment 600. Additional or fewer components may be attached (or stacked together). In some instances, the barrel attachment 600 and/or each of the first 628, second 630, and third 632 components may include an attachment assembly, such as a quick detach assembly or a threaded attachment assembly discussed above, for attachment to one another. Any attachment assembly may be used. In this manner, components and/or accessories may be stacked together. For example, a weight may be attached to a compensator or a suppressor. Any combination is possible. The components may be attached to one another in any manner, including, but not limited to, compression fitted, clipped, latched, bolted, screwed, pinned, quick detached, welded, or the like.

Figure 21:
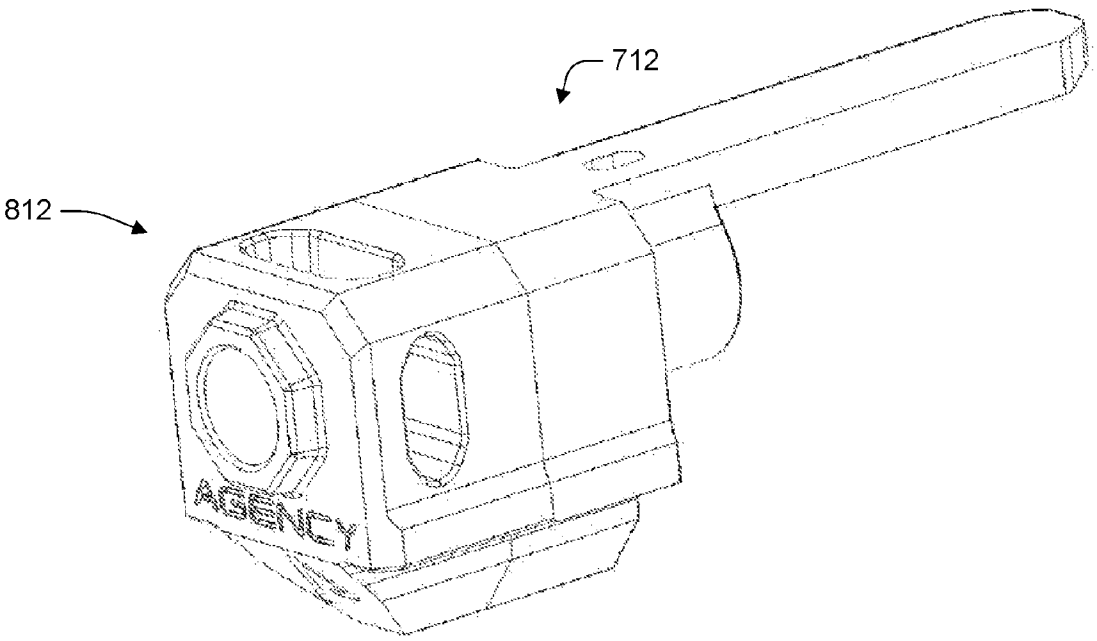
FIG. 21 depicts a barrel attachment assembly in accordance with one or more embodiments of the disclosure.
Figure 22:
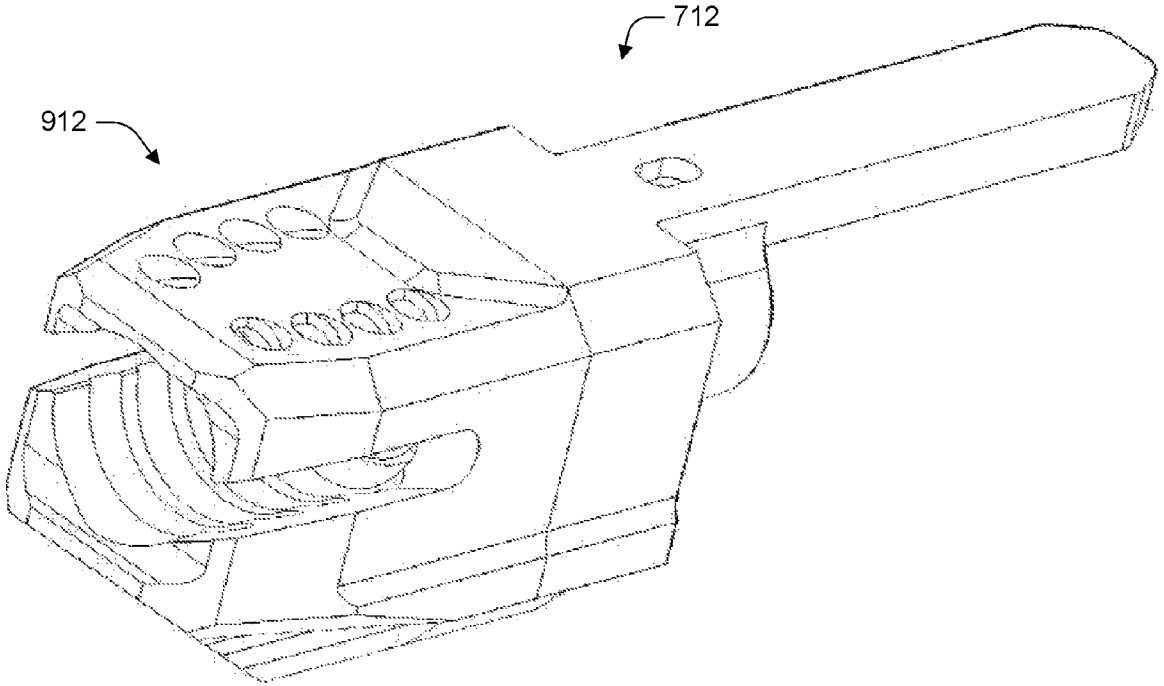
FIG. 22 depicts a barrel attachment assembly in accordance with one or more embodiments of the disclosure.
Figure 23:
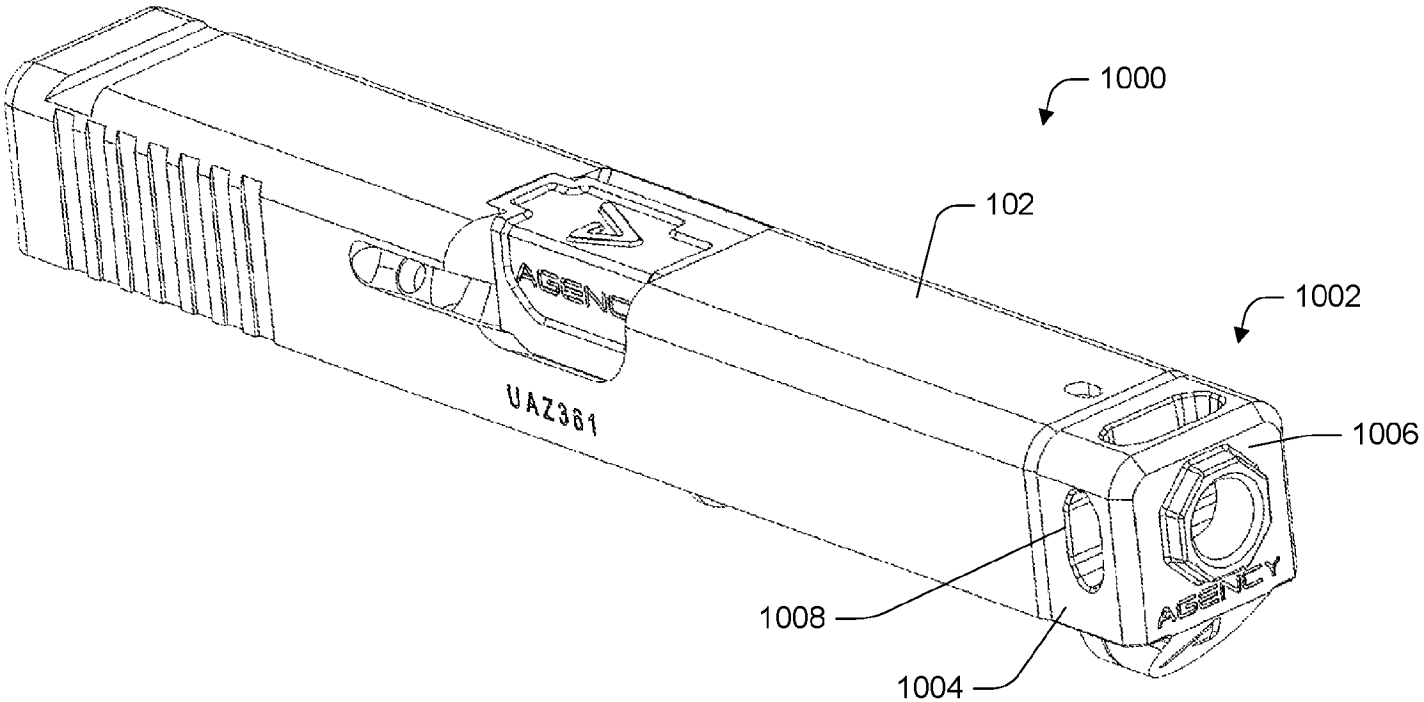
FIG. 23 depicts an upper view of a barrel attachment assembly in accordance with one or more embodiments of the disclosure.
Figure 24:
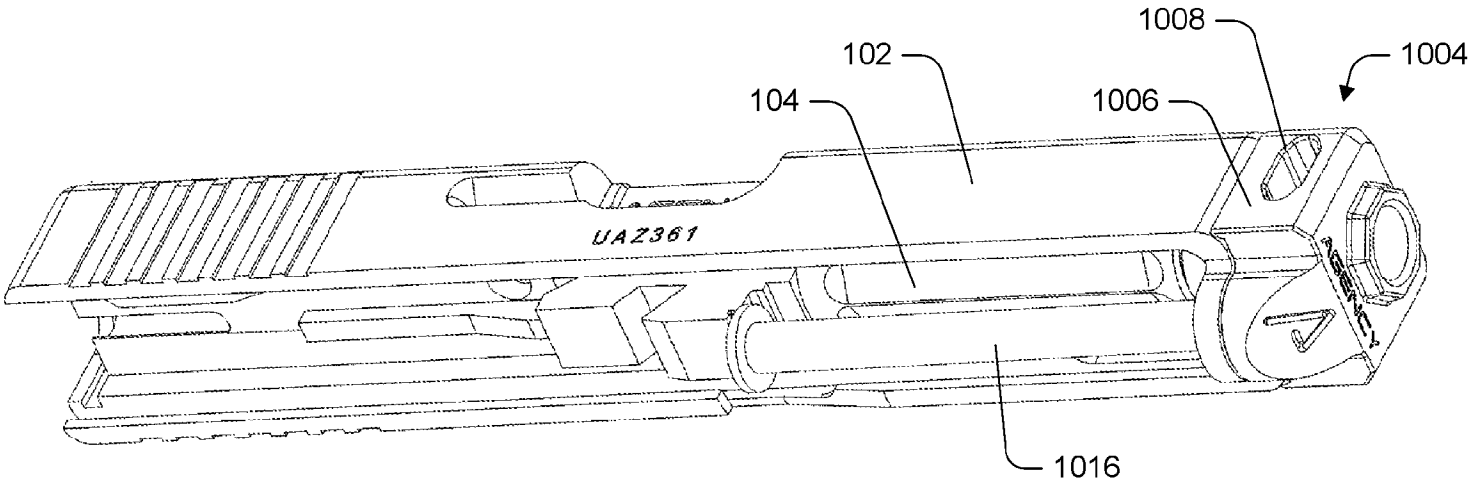
FIG. 24 depicts a lower view of a barrel attachment assembly in accordance with one or more embodiments of the disclosure.

FIGS. 21 and 22 depict example embodiments of stacked components. For example, FIG. 21 depicts a compensator 812 attached to a weighted attachment 712. FIG. 22 depicts a flash hider 912 attached to the weighted attachment 712. Additional components may be attached.

FIGS. 23-25B depict a barrel attachment assembly 1000. The barrel attachment assembly 1000 also may include a barrel attachment 1002. The barrel attachment 1002 may be a compensator, a weighted attachment, a flash hider, a quick detach mount, a threaded mount, or the like. In certain embodiments, the barrel attachment 1002 may be a compensator 1004. The compensator 1004 may include a main body 1006. The main body 1006 may be any size, shape, or configuration. In some instances, the main body 1006 may be generally rectangular. The main body 1006 may include one or more discharge ports 1008. The main body 1006 may include any number of discharge ports 1008. The discharge ports 1008 may be located anywhere on the main body 1006, such as the top, bottom, sides, etc. The discharge ports 1008 may be any size, shape, or configuration. The main body 1006 may be any type of compensator.

Figure 25A:
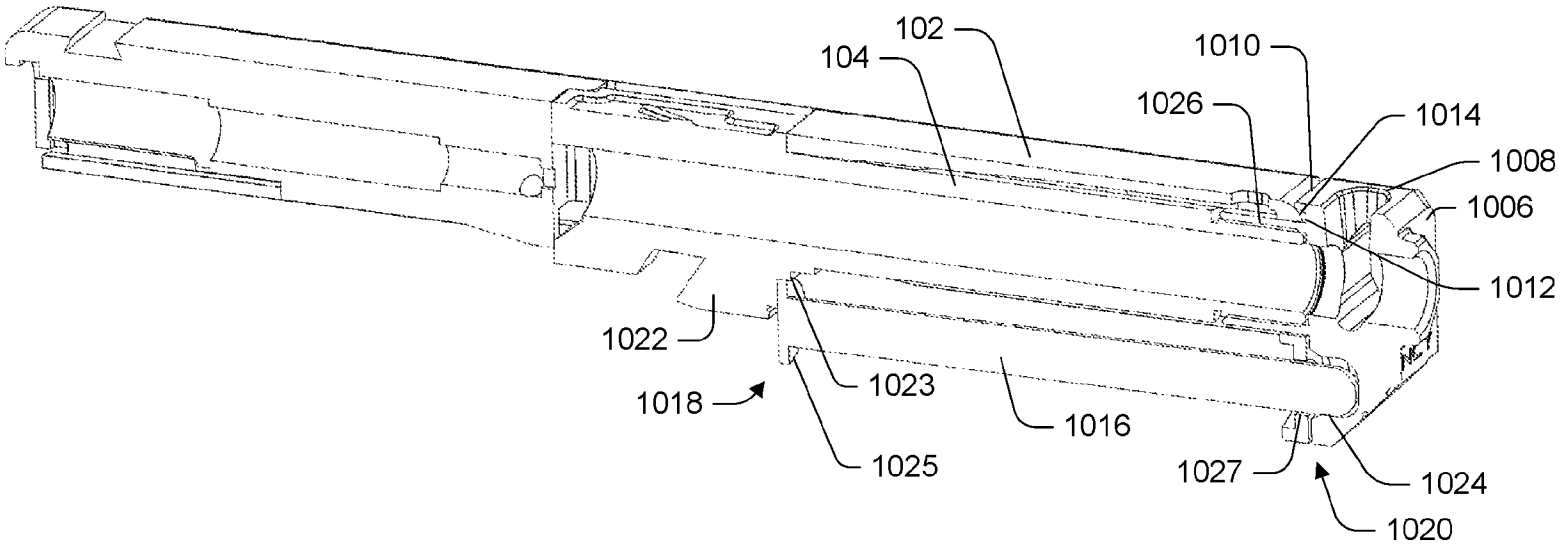
FIG. 25A depicts a cross-sectional view of a barrel attachment assembly in accordance with one or more embodiments of the disclosure.
Figure 25B:
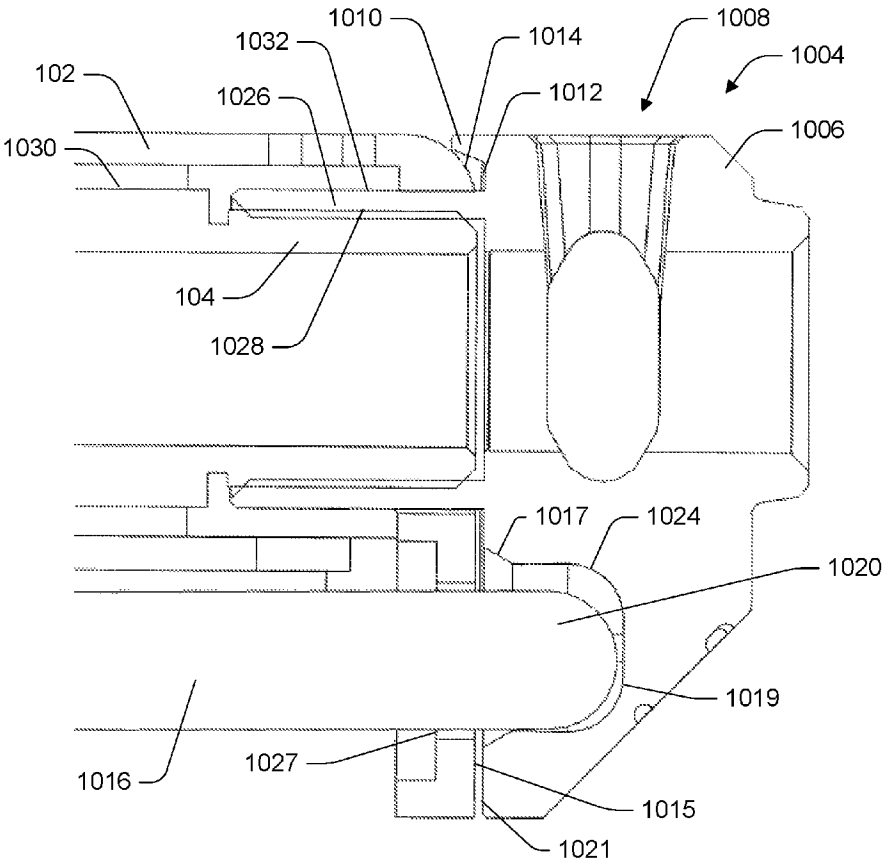
FIG. 25B depicts a cross-sectional view of a barrel attachment assembly in accordance with one or more embodiments of the disclosure.

As depicted in FIGS. 25A and 25B, a lip 1010 may extend from an inner surface 1012 of the main body 1006. In some instances, the lip 1010 may extend about the entire perimeter of the main body 1006. In other instances, the lip 1010 may extend about a portion of the perimeter of the main body 1006. For example, the lip 1010 may extend from a top portion of the inner surface 1012 of the main body 1006. The lip 1010 may fill any potential gaps between the main body 1006 and a front surface 1014 of the slide 102.

The barrel attachment assembly 1000 may be a "tool less" attachment. That is, barrel attachment assembly 1000 may be attached to the firearm without the use of a tool. For example, the barrel attachment assembly 1000 may include a guide rod 1016. The guide rod 1016 may include a first end 1018 and a second end 1020. The first end 1018 of the guide rod 1016 may be disposed against a lug 1022. In some instances, the lug 1022 may be integrally formed with the barrel 104. The lug 1022 may include one or more notches 1023 or cuts that mate with a lip 1025 at the first end 1018 of the guide rod 1016. The second end 1020 of the guide rod 1016 may extend through a hole 1027 in the slide 102 beyond the front surface 1015 of the lower portion of the slide 102. For example, the second end 1020 of the guide rod 1016 may be disposed within a cavity 1024 in a bottom portion of the main body 1006 of the compensator 1004. The cavity 1024 may include a tapered opening 1017 and a closed end 1019. In some instances, the cavity 1024 may be rounded. The cavity 1024 may be any size, shape, or configuration. The cavity 126, 226, 326, 426, and 526 may include a similar configuration. In some instances, the front surface 1015 of the lower portion of the slide 102 and may be spaced apart from an inner surface 1021 of bottom portion of the main body 1006. In other instances, the front surface 1015 of the lower portion of the slide 102 may abut the inner surface 1021 of bottom portion of the main body 1006. The guide rod 1016 may be used to time and align the compensator 1004. In addition, the threading in the barrel attachment bore 1026 may be tightened at a position to align with the slide 102 and the guide rod 1016.The guide rod 1016 may maintain the compensator 1004 in the proper alignment before, during, and after discharging the firearm. For example, the discharge ports 1008 may have a desired alignment for recoil management of the firearm during discharge, and such alignment, also referred to as timing, may be maintained by the guide rod 1016 being at least partially disposed within the cavity 1024 before and during discharge of the firearm, thereby preventing rotation of the main body 1006. Moreover, the guide rod 1016 may enable the compensator 1004 to be attached to the firearm without the use of tools, such as set screws or pins.

In some instances, the compensator 1004 may include a barrel attachment bore 1026. The barrel attachment bore 1026 may include internal threads or the like. In this manner, the barrel attachment bore 1026 may be threaded onto an end (i.e., the muzzle) of the barrel 104. That is, an end of the barrel 104 may include external threads that the barrel attachment bore 1026 may be threaded on. In some instances, the muzzle end of the barrel 104 may include an outer diameter 1028 less than an outer diameter 1030 of the remainder of the barrel 104. In this manner, the barrel attachment 1026 may be attached (e.g., threaded) to the muzzle end of the barrel 104. In some instances, an outer diameter 1032 of the barrel attachment 1026 may be about equal to the outer diameter 1030 of the remainder of the barrel 104, which is depicted in FIG. 25B. When attached to the muzzled of the barrel 104, the barrel attachment bore 1026 may be disposed within the slide 102 when the firearm is in the repose position (i.e., before the firearm is discharged), as depicted in FIG. 25. In this manner, the muzzle of the barrel 104 may be disposed within the slide 102 before the firearm is discharged, and the attachment point 1026 of the compensator 1004 to the muzzle end of the barrel 104 may be within the slide 102.

The compensator 1004 may be attached to the barrel 104 in any manner, including, but not limited to, compression fitted, clipped, latched, bolted, screwed, pinned, quick detached, welded, or the like. In some instances, the compensator 1004 may be integrally formed with the barrel 104. That is, the barrel 104 and the compensator 1004 may be a single piece. The compensator 1004 may be detachably screwed to the barrel 104, but may not require a torque fit because the guide rod 1016 may keep the compensator 1004 from unscrewing. The top surface of the slide 102 may include a dovetail for attaching a sight thereto. The top surface of the slide 102 also may include a sight attachment hole for attaching a sight thereto.

Figure 26:
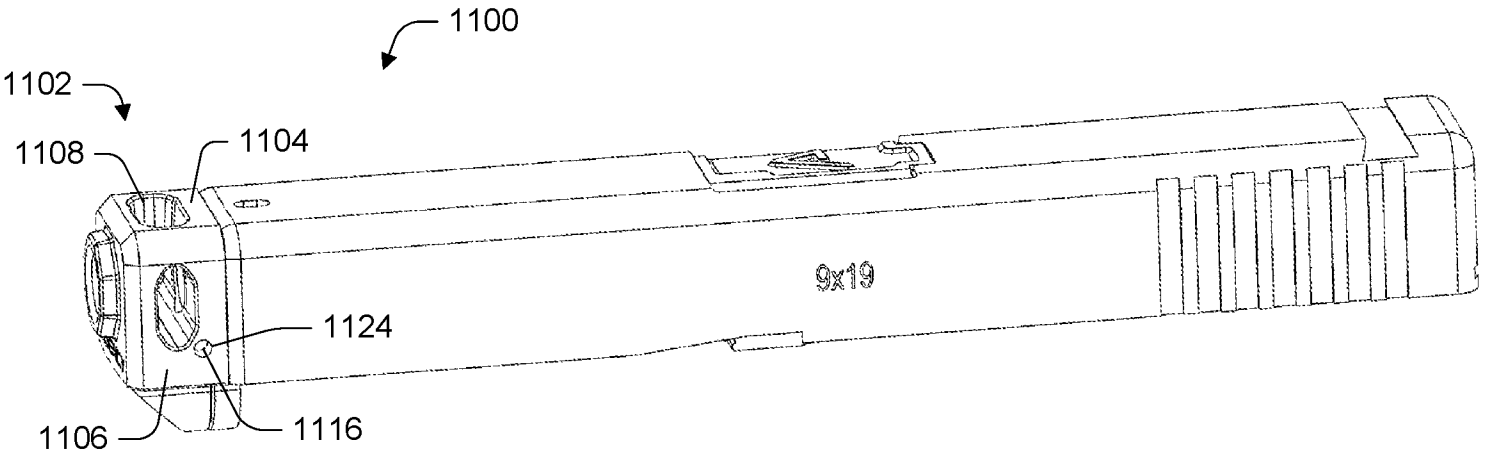
FIG. 26 depicts an upper view of a barrel attachment assembly in accordance with one or more embodiments of the disclosure.
Figure 27:
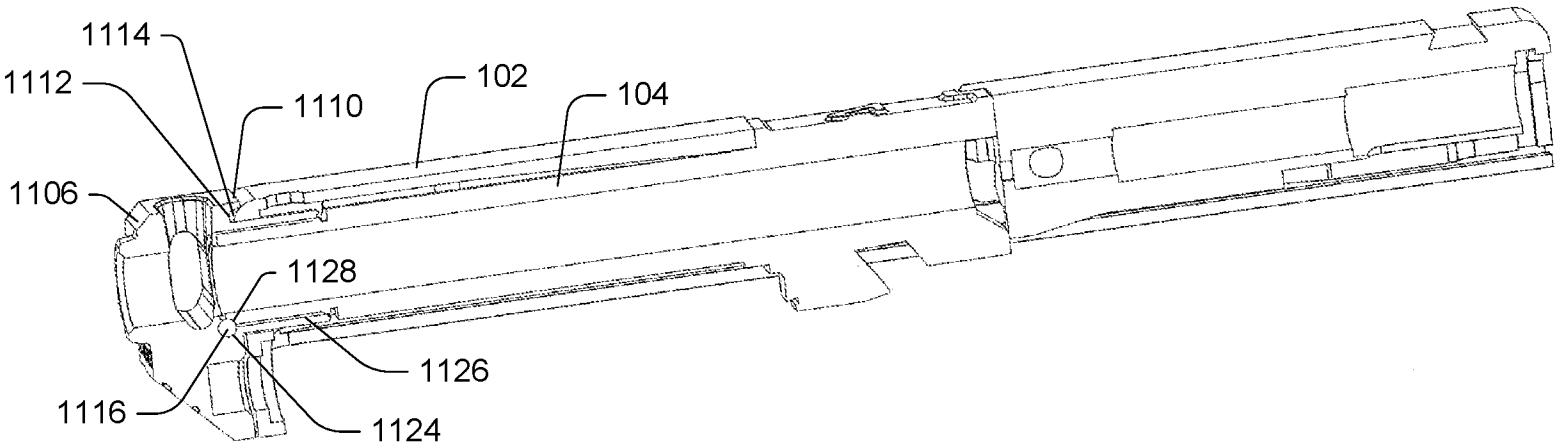
FIG. 27 depicts a cross-sectional view of a barrel attachment assembly in accordance with one or more embodiments of the disclosure.

FIGS. 26 and 27 depict a barrel attachment assembly 1100. The barrel attachment assembly 1100 also may include a barrel attachment 1102. The barrel attachment 1102 may be a compensator, a weighted attachment, a flash hider, a quick detach mount, a threaded mount, or the like. In certain embodiments, the barrel attachment 1102 may be a compensator 1104. The compensator 1104 may include a main body 1106. The main body 1106 may be any size, shape, or configuration. In some instances, the main body 1106 may be generally rectangular. The main body 1106 may include one or more discharge ports 1108. The main body 1106 may include any number of discharge ports 1108. The discharge ports 1108 may be located anywhere on the main body 1106, such as the top, bottom, sides, etc. The discharge ports 1108 may be any size, shape, or configuration. The main body 1106 may be any type of compensator.

A lip 1110 may extend from an inner surface 1112 of the main body 1106. In some instances, the lip 1110 may extend about the entire perimeter of the main body 1106. In other instances, the lip 1110 may extend about a portion of the perimeter of the main body 1106. For example, the lip 1110 may extend from a top portion of the inner surface 1112 of the main body 1106. The lip 1110 may fill any potential gaps between the main body 1106 and a front surface 1114 of the slide 102.

In some instances, the compensator 1104 may include a barrel attachment bore 1126. The barrel attachment bore 1126 may include internal threads or the like. In this manner, the barrel attachment bore 1126 may be threaded onto an end (i.e., the muzzle) of the barrel 104. That is, an end of the barrel 104 may include external threads that the barrel attachment bore 1126 may be threaded on. When attached to the muzzled of the barrel 104, the barrel attachment bore 1126 may be disposed within the slide 102 when the firearm is in the repose position (i.e., before the firearm is discharged), as depicted in FIG. 27. In this manner, the muzzle of the barrel 104 may be disposed within the slide 102 before the firearm is discharged, and the attachment point 1126 of the compensator 1104 to the muzzle end of the barrel 104 may be within the slide 102.

The compensator 1004 may be attached to the barrel 104 in any manner, including, but not limited to, compression fitted, clipped, latched, bolted, screwed, pinned, quick detached, welded, or the like. In some instances, the compensator 1104 may be integrally formed with the barrel 104. That is, the barrel 104 and the compensator 1104 may be a single piece. The compensator 1104 may be detachably screwed to the barrel 104.

In some instances, a pin 1116 may be used to time and align the compensator 1004. The pin 1116 may maintain the compensator 1104 in the proper alignment before, during, and after discharging the firearm. For example, the discharge ports 1108 may have a desired alignment for recoil management of the firearm during discharge, and such alignment, also referred to as timing, may be maintained by the pin 1116. The pin 1116 may pass through the main body 1106 and abut the barrel 104. In this manner, pin 116 may lock the compensator 1104 in the proper alignment relative to the barrel 104. For example, the main body 1106 may include an aperture 1124 in which the pin 1116 passes through to abut the barrel 104. In some instances, the pin 1116 may be press fit in the aperture 1124. For example, aperture 1124 in the main body 1106 may run perpendicular to a barrel bore axis. When the compensator 1104 is threaded onto the end of the barrel 104, the aperture 1124 may line up with a slot 1128 that is milled perpendicular to the bore axis into the end of the barrel 104. Once the compensator 1104 and barrel slot 1128 are lined up, the pin 1116 may then be press fit into the aperture 1124, which locates/indexes the compensator 1104 to the barrel 104. The top surface of the slide 102 may include a dovetail for attaching a sight thereto. The top surface of the slide 102 also may include a sight attachment hole for attaching a sight thereto.

The various components of the barrel attachment assembly depicted in FIGS. 1-27 may be interchanged. That is, features disclosed in one embodiment may be incorporated into other embodiments. Any combination is possible. For example, the embodiments disclosed in FIGS. 23-27 may include flash hiders, compensators, stacked assembly, quick detach assembly, etc. disclosed in the other embodiments.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A firearm assembly, comprising:

a slide comprising a guide slot;

a barrel attachment comprising a main body and an elongated guide beam, wherein the elongated guide beam is configured to slide within the guide slot;

a barrel attachment bore disposed below the elongated guide beam; and a sight attachment hole through the barrel attachment bore and the elongated guide beam.

2. The assembly of claim 1, wherein the main body comprises a compensator, a weighted attachment, a quick detach barrel attachment, a flash hider, or a threaded barrel attachment.

3. The assembly of claim 1, wherein the barrel attachment bore is attachable to a muzzle end of a barrel inside of the slide.

4. The assembly of claim 1, further comprising a sight attachment access port through the barrel attachment bore.

5. The assembly of claim 1, further comprising a recoil spring end cap cavity extending from the main body.

6. The assembly of claim 1, wherein the guide slot is disposed on a top portion of the slide.

7. The assembly of claim 6, wherein the elongated guide beam extends from a top portion of the main body.

8. The assembly of claim 1, wherein the main body comprises one or more discharge ports.

9. A firearm compensator assembly, comprising:

a slide comprising a guide slot disposed on a top portion thereof; and a compensator comprising:

a main body having one or more discharge ports, an elongated guide beam extending rearward from a top portion of the main body, wherein the elongated guide beam is configured to slide within the guide slot when the compensator is attached to an end of a barrel, a barrel attachment bore extending from the main body and disposed below the elongated guide beam, and a sight attachment hole through the barrel attachment bore and the elongated guide beam.

10. The assembly of claim 9, wherein the barrel attachment bore is attachable to a muzzle end of a barrel inside of the slide.

11. The assembly of claim 9, wherein the compensator further comprises a sight attachment access port through the barrel attachment bore.

* * * * *